US006656140B2

(12) United States Patent
Oguma et al.

(10) Patent No.: US 6,656,140 B2
(45) Date of Patent: Dec. 2, 2003

(54) MASSAGE APPARATUS HAVING MASSAGE ROLLERS MOUNTED TO AN ARM HOUSING WHICH INCLUDES IMPROVED SLIDER ARRANGEMENT

(75) Inventors: Yoshio Oguma, Tokyo (JP); Shoji Oshita, Saitama (JP)

(73) Assignee: France Bed Co., Ltd., Tokyo (JP)

( * ) Notice: Subject to any disclaimer, the term of this patent is extended or adjusted under 35 U.S.C. 154(b) by 147 days.

(21) Appl. No.: 09/804,637

(22) Filed: Mar. 1, 2001

(65) Prior Publication Data

US 2001/0011160 A1 Aug. 2, 2001

Related U.S. Application Data

(63) Continuation of application No. PCT/JP00/03939, filed on Jun. 16, 2000.

(30) Foreign Application Priority Data

Jul. 7, 1999 (JP) ..... 11-193025

(51) Int. Cl.[7] ..... A61H 15/00

(52) U.S. Cl. ..... 601/99; 601/90; 601/101; 601/103

(58) Field of Search ..... 601/97–103, 89, 601/90, 93, 94

(56) References Cited

U.S. PATENT DOCUMENTS 5,330,416 A * 7/1994 Masuda et al. ..... 601/52
5,755,677 A * 5/1998 Masuda et al. ..... 601/102
6,443,917 B1 * 9/2002 Canto ..... 601/101

FOREIGN PATENT DOCUMENTS

JP 62-125536 8/1987
JP 9-192188 7/1997

* cited by examiner

*Primary Examiner*—Justine R. Yu
(74) *Attorney, Agent, or Firm*—Frishauf, Holtz, Goodman & Chick, P.C.

(57) ABSTRACT

A first drive shaft having a pair of eccentric shaft portions at its middle part and a second drive shaft on which a pair of eccentric cum bodies having eccentric cum portions are provided, are provided in a holding body. A pair of arms are provided on the eccentric shaft portions of the first drive shaft so as to freely oscillate and main massage rollers are provided on each of the arms. The kneading movement is assigned to the main massage rollers by a drive mechanism by selectively rotating the first drive shaft or the second drive shaft. Each arm is composed of an arm housing having a first opening portion, and an arm cover which forms a holding portion having a second opening portion, being bonded to the arm housing and holding a slider so as to freely slide between the bonded surfaces.

6 Claims, 19 Drawing Sheets

MASSAGE APPARATUS HAVING MASSAGE ROLLERS MOUNTED TO AN ARM HOUSING WHICH INCLUDES IMPROVED SLIDER ARRANGEMENT

CROSS-REFERENCE TO RELATED APPLICATIONS

This is a Continuation Application of PCT Application No. PCT/JP00/03939, filed Jun. 16, 2000, which was not published under PCT Article 21(2) in English.

This application is based upon and claims the benefit of priority from the prior Japanese Patent Application No. 11-193025, filed Jul. 7, 1999, the entire contents of which are incorporated herein by reference.

BACKGROUND OF THE INVENTION

This invention relates to a massage apparatus capable of providing a massage such as pounding and kneading to a user by means of massage rollers.

A massage apparatus reciprocating massage rollers along a determined direction and massaging the user's back by means of the massage rollers is known. In this kind of the massage apparatus, a mattress type capable of providing massage to the overall back of the user while the user lies on his or her back, and a chair type capable of providing massage to parts higher than the waist while the user sits down are known.

These massage apparatuses cannot only make the massage rollers run, but also allow them to selectively provide the pounding movement and the kneading movement, in order to enhance the massage effect.

To allow the massage rollers to selectively provide the pounding movement and the kneading movement, the massage apparatus is required to adopt a structure capable of certainly making each movement. That is, the massage apparatus must be constituted to be capable of certainly pounding the user by means of the massage rollers when it is to make the pounding movement, and certainly kneading the user by means of the massage rollers when it is to make the kneading movement.

In a conventional massage apparatus, a pounding shaft and a kneading shaft are provided to allow the massage rollers to selectively provide the pounding movement and the kneading movement. An eccentric shaft portion is provided on the pounding shaft, and proximal end portions of arms are coupled on the eccentric shaft portion so as to be capable of rotating and oscillating.

The massage rollers are rotatably provided on a top side portion of each arm rather than the proximal portion thereof and a slider is further provided on the top side portion so as to freely slide along a determined direction. An eccentric cum body is provided on the kneading shaft and is fitted in a fitting hole formed on the slider.

Thus, when the pounding shaft is rotated, the arm rotates with the proximal portion serving as a fulcrum and the massage rollers can thereby make the pounding movement. By rotating the kneading shaft, the arm oscillates and the massage rollers can thereby make the kneading movement.

To slidably provide the slider on the arm, however, the structure of sequentially stacking and fixing a slider receiver and a cover on one side surface of the arm through a spacer has been adopted in the conventional massage apparatus.

For this reason, the structure of slidably providing the slider on the arm is complicated, the number of parts is increased, much labor is required to the assembly, and thereby the manufacturing costs are increased.

In addition, since the massage rollers are rotatably provided on the arm, the support shaft is attached to the arm and the massage rollers are supported on the support shaft.

For this reason, much labor is not only required for the attachment of the support shaft, but also the support shaft may become loose due to the use in a long term by attaching the support shaft to the arm by means of, for example, a screw or the like.

Moreover, if the slider is simply provided to slide by the slider receiver, the slider becomes loose in accordance with the accuracy in production of the slider or the slider receiver. Therefore, the massage rollers provided on the arm also become loose due to the looseness of the slider and cannot certainly make the pounding movement or the kneading movement.

BRIEF SUMMARY OF THE INVENTION

This invention aims to provide a massage apparatus which can be easily assembled with a small number of components to have a comparatively simple structure and can be manufactured at small costs, and which allows a slider to be slidably provided on an arm.

According to an embodiment of this invention, there is provided a massage apparatus comprising:

- a holding body for reciprocating along a predetermined direction;
- a first drive shaft having a pair of eccentric shaft portions at a middle portion thereof, and being provided in the holding body while having an axis substantially perpendicular to a running direction of the holding body;
- a second drive shaft provided in the holding body while having an axis parallel to the first drive shaft;
- a pair of eccentric cum bodies each having an eccentric cum portion which is eccentric to a middle portion of the second drive shaft and which has an axis inclined to the axis of the second drive shaft;
- a pair of arms each having a proximal end portion attached to the eccentric shaft portion of the first drive shaft by a bearing so as to freely oscillate;
- a pair of main massage rollers provided at two parts on top sides of the respective arms closer than the proximal end portions thereof, so as to freely rotate at a predetermined distance;
- a slider held to freely slide along a predetermined direction at a part between the pair of main massage rollers of the arms, and fitted in the eccentric cum portions so as to freely rotate, for sliding relatively to the arms interlocking the eccentric rotation of the eccentric shaft portions of the first drive shaft; and
- a drive mechanism provided in the holding body, for selectively rotating any one of the first and second drive shafts, for assigning pounding movement to the main massage rollers in accordance with the eccentric rotation of the eccentric shaft portions by driving the first drive shaft, and for assigning kneading movement to the main massage rollers in accordance with the eccentric rotation of the eccentric cum bodies by driving the second drive shaft, wherein each of the arms is composed of:

- an arm housing having a first opening portion; and
- an arm cover having a second opening portion facing the first opening portion, for forming a holding portion bonded to the arm housing to hold the slider to freely slide along a predetermined direction between the bonding surfaces.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of this invention will be explained below with reference to the drawings.

FIGS. 1 to 32 show a first embodiment of the present invention. A mattress type massage apparatus shown in FIG. 1 comprises a base body 1 shaped in a rectangular flat plate. The base body 1 is formed of synthetic resin shaped in a flexible sheet and can be bended at a middle part in the longitudinal direction.

The base body 1 may be constituted by, for example, a synthetic resin sheet or by superposing a plurality of synthetic resin sheets having different hardness and strength. Further, the base body 1 is not limited to a synthetic resin sheet or a plurality of superposed synthetic resin sheets, but may be constituted in a framework structure or the like. The base body 1 is not limited at all to the structure, type, material or the like.

Figure 5A:
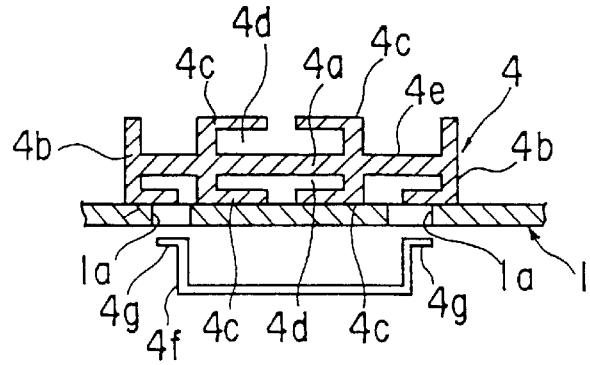
FIG. 5A is a sectional view showing an attachment structure of a base body and the guide rail.
Figure 5B:
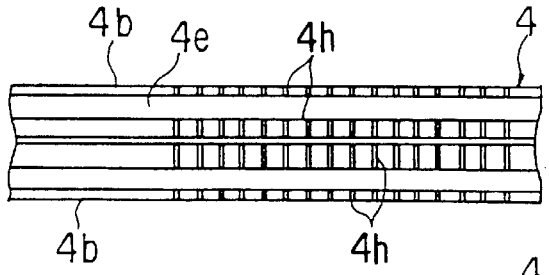
FIG. 5B is a plan view showing the guide rail.
Figure 5C:
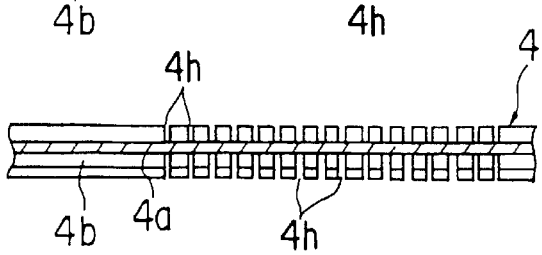
FIG. 5C is a sectional view showing the guide rail.

A pair of guide rails 4 molded of nylon (name of an article) or synthetic resin such as polypropylene are mounted in parallel, remote from one another, at both end parts in the lateral direction on the top surface of the base body 1. Each of guide rails 4 has a strip-shaped base portion 4*a* and L-shaped support portions 4*b* are formed on both ends in the lateral direction of the base portion 4*a* as shown in FIGS. 5A to 5C. A pair of L-shaped elements 4*c* project from each of upper and lower surfaces of a middle part of the base portion 4*a*, so as to face one another. Thus, a passage 4*d* is formed on each of upper and lower surfaces of the base portion 4*a* and a side of the upper passage 4*d* serves as a running surface 4*e* of wheels 114 as described later.

The guide rail 4 is held by a plurality of holding members 4*f* to be able to slide on the top surface of the base body 1.

That is, each of holding members 4*f* is substantially formed in a bracket shape as shown in FIG. 5A. A middle part of the holding member 4*f* is bonded on the lower surface of the base body 1. Engagement portions 4*g* bent in an L shape at both ends of the holding member 4*f* project from a pair of openings la formed on the base body 1 toward the top surface of the base body 1 and engage with the support portions 4*b* of the guide rail 4. Thus, the guide rail 4 is held to be able to slide on the base body 1.

A plurality of slits 4*h* are formed with a predetermined distance disposed therebetween, at one or two portions of the middle part of the guide rail 4 other than the base portion 4*a* as shown in FIGS. 5B and 5C. For this reason, the guide rail 4 can be bended together with the base body 1 at the slits 4*h*.

Cushion members 5 formed of an elastic material such as urethane foam are provided at the outer side and one longitudinal end side, respectively, on the top surface of the base body 1.

Figure 1:
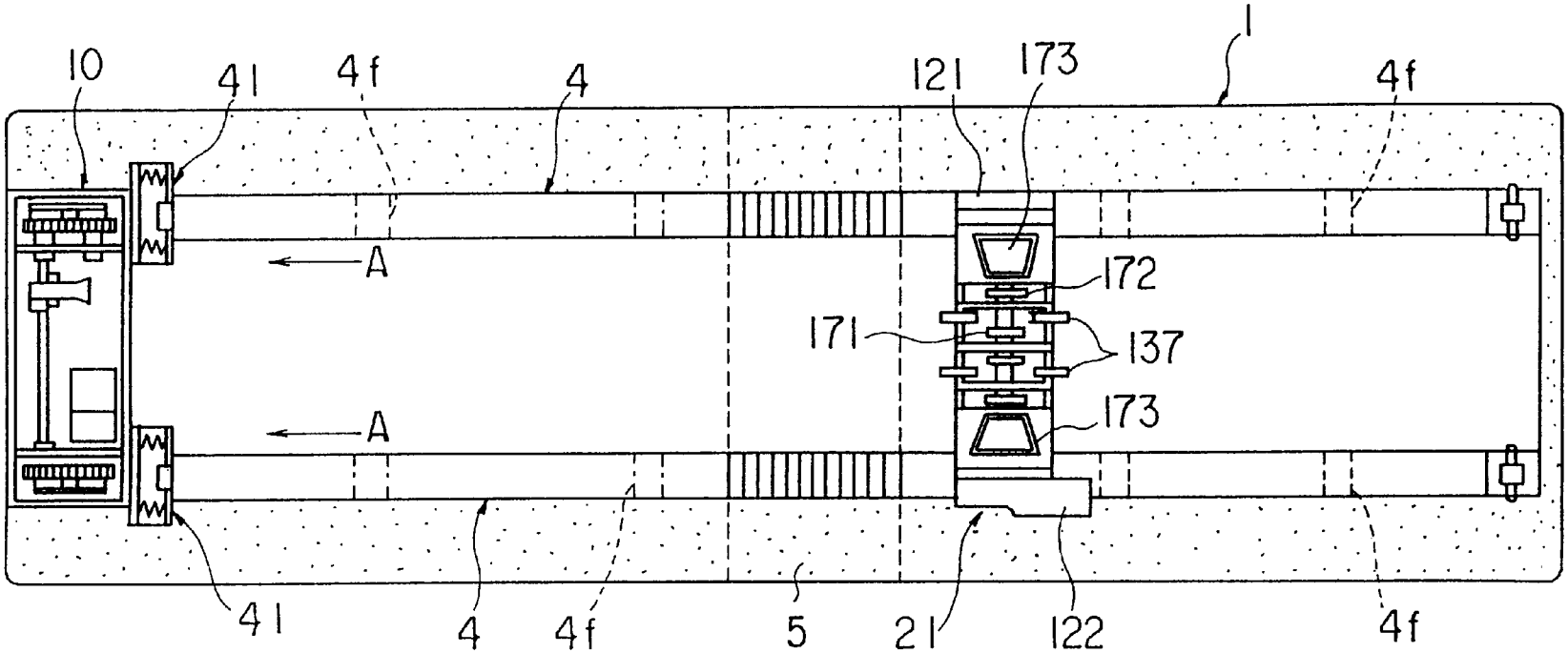
FIG. 1 is a plan view showing a massage apparatus from which an exterior cover is removed, according to a first embodiment of the present invention.
Figure 2:
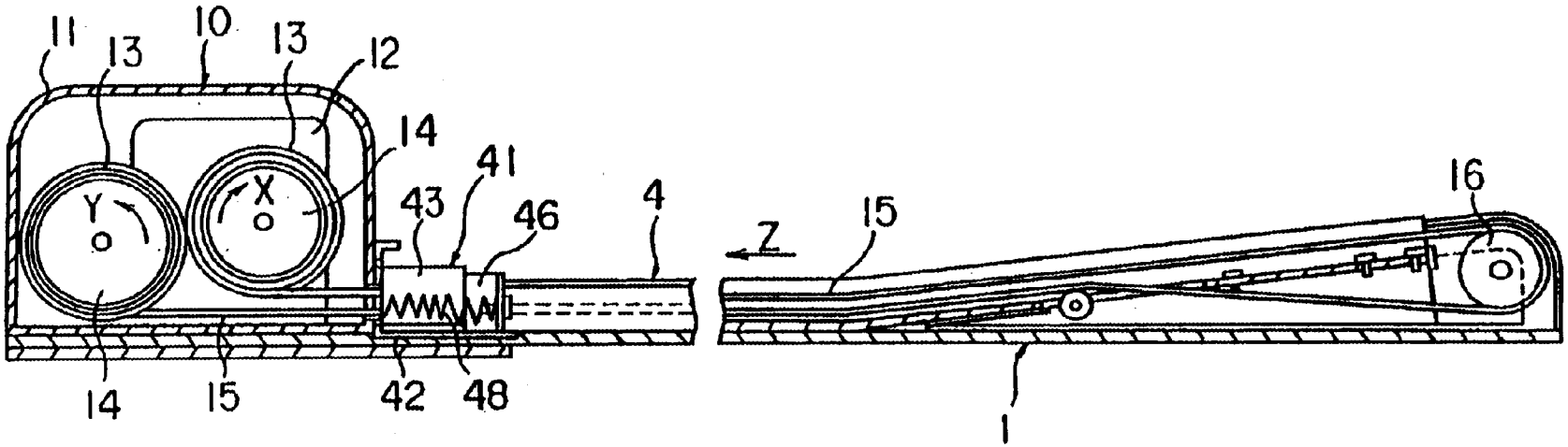
FIG. 2 is a partially sectional side view showing the massage apparatus.
Figure 4:
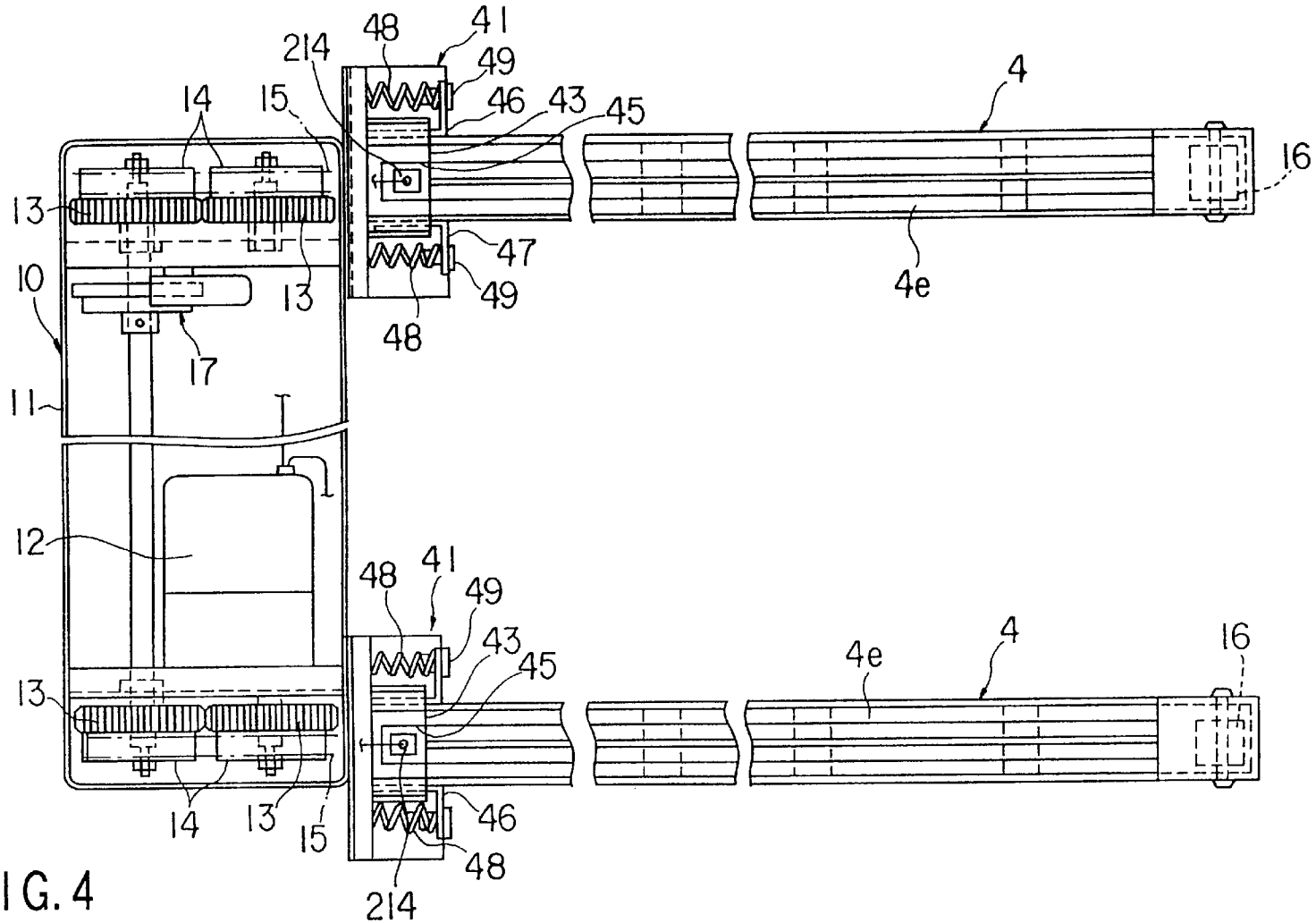
FIG. 4 is a plan view showing a drive device and a pair of guide rails.

As shown in FIG. 1, a drive device 10 is provided as a first drive mechanism, on the top surface of one longitudinal end side of the base body 1, i.e. at one side end of the guide rails 4. The drive device 10 has a casing 11 as shown in FIGS. 2 and 4. A drive source 12 in which a speed reducer and a motor are integrally constituted is provided in the casing 11. The drive source 12 allows a pair of gears 13, which are provided on each side of the casing 11, to be rotated in opposite directions. A drive pulley 14 is provided integrally with each of the gears 13.

As shown in FIG. 2, end portions of a belt 15, which serves as a power transmission member composed of a metal strip such as stainless steel, are wound round the paired drive pulleys 14, respectively. The middle parts of the belt 15 pass through the upper and lower passages 4*d* of the guide rail 4 and are hooked on a follower roller 16, which is provided to be freely rotatable on the other end of the guide rail 4.

When the drive source 12 is operated to drive the paired gears 13 in opposite directions, the belt 15 is paid out from the drive pulley 14 of one of the gears 13 and wound round the drive pulley 14 of the other gear 13. The belt 15 is thereby driven to run along the passages 4*d*.

In FIG. 2, for example, if one of the drive pulleys 14 is rotated in a direction of an arrow X and the other drive pulley 14 is rotated in a direction of an arrow Y, the part of the belt 15 passing through the upper passage 4*d* is driven to run in a direction represented by an arrow Z.

As shown in FIG. 4, a running range setting mechanism 17 for reciprocating the belt 15 within a certain running range is provided in the casing 11. The running range setting mechanism 17, for example, detects the running distance of the belt 15 in accordance with the number of rotations of the drive pulleys 14 and the like and changes the direction of the rotation of the gears 13 made by the drive source 12 in accordance with the detection signal, though not shown in detail. The belt 15 thereby reciprocates within a certain running range.

Figure 32:
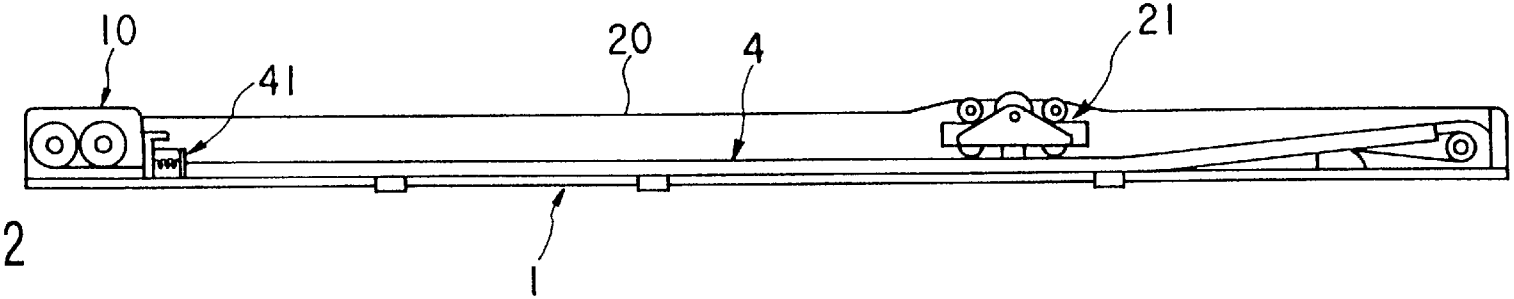
FIG. 32 is a side view schematically showing the massage apparatus.

A holding body 21 driven to run by the belt 15 is provided between the paired guide rails 4 as shown in FIG. 1. The structure of the holding body 21 will be explained later. The top side of the holding body 21, i.e. the top side of the base body 1 is covered by an exterior cover 20 as shown in FIG. 32, such that the user lies on the exterior cover 20.

Tension adjusting means 41 for controlling the tension of the belt 15 are provided at the end of the paired guide rails 4, which is positioned on the side of the drive device 10 as shown in FIG. 1. Each of the tension adjusting means 41 has a holding member 42 obtained by bending a plate to make the side surface thereof shaped substantially in a bracket as shown in FIGS. 6 to 9.

The holding member 42 is provided with the back wall bonded to the casing 11 of the drive device 10. A guide member 43 is provided on a top surface of the bottom part of the holding member 42. Guide grooves 44 are formed at both sides of the guide member 43 by bending the guide member 43 in a shape of a mountain having a strip-shaped member. The lower ends of both side of the guide member 43 are fixed on the top surface of the bottom part of the holding member 42. A bracket-shaped cutaway portion 45 is formed on the middle part of the guide member 43.

A slide member 46 is supported by the holding member 42 so as to be freely slidable. The slide member 46 is formed by bending a strip plate like member such that its plane surface is shaped substantially in a bracket. The middle part of the slide member 46 is formed to be lower than the middle part where the cutaway portion 45 of the guide member 43 is formed.

Both side edges of the slide member 46 are inserted into the guide groove 44 so that the slide member 46 can slide freely therein. That is, the slide member 46 is guided in the guide groove 44 and can slide along the top surface of the bottom part of the holding member 42.

Figure 7:
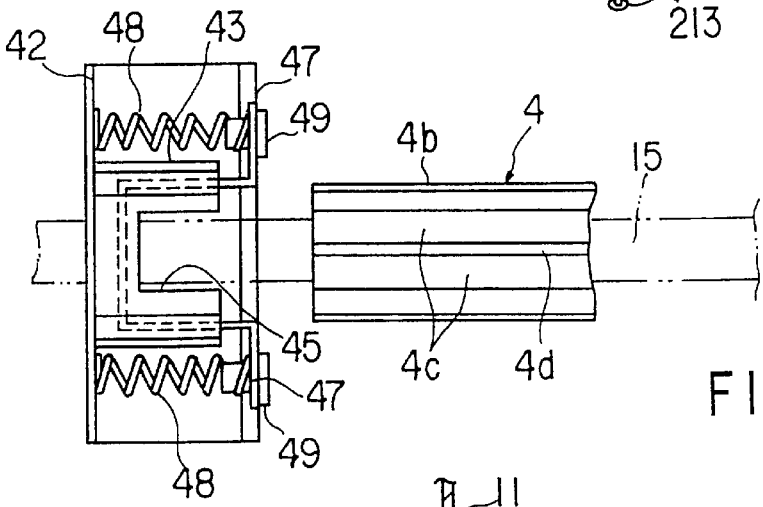
FIG. 7 is partially sectional plan view showing the tension adjusting means.

A proximal end of each side edge of the slide member 46 is bent in an L letter as a support element 47. A spring 48 serving as an elastic member is provided between the support element 47 and the back wall of the holding member 42. That is, as shown in FIG. 7, one end of the spring 48 is held by a pin 49 provided at the support element 47 and the other end thereof is made to abut on the back wall of the holding member 42.

Figure 6:
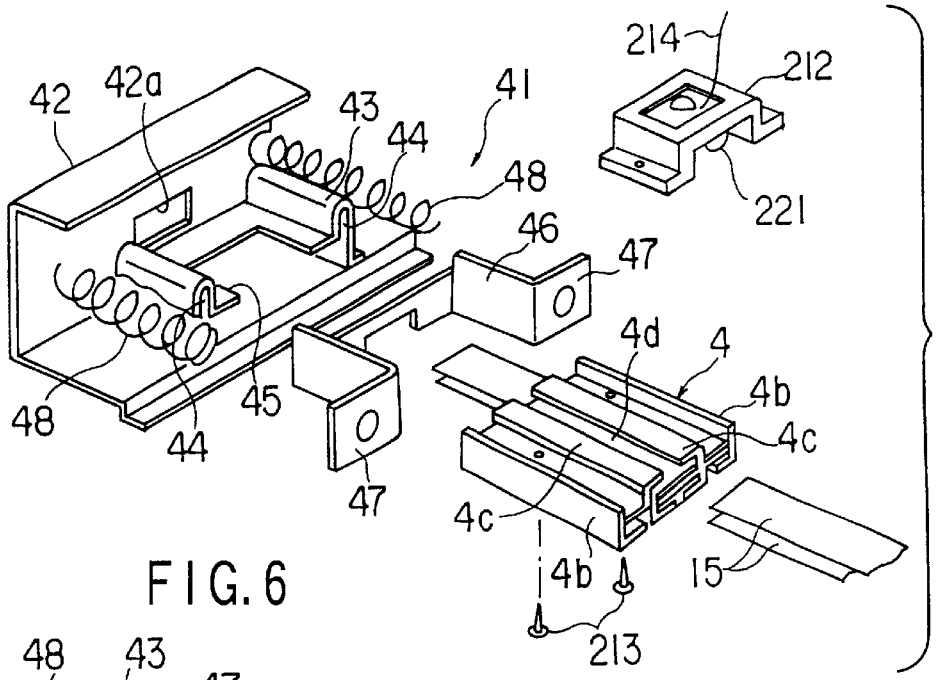
FIG. 6 is an exploded perspective view showing tension adjusting means.
Figure 8:
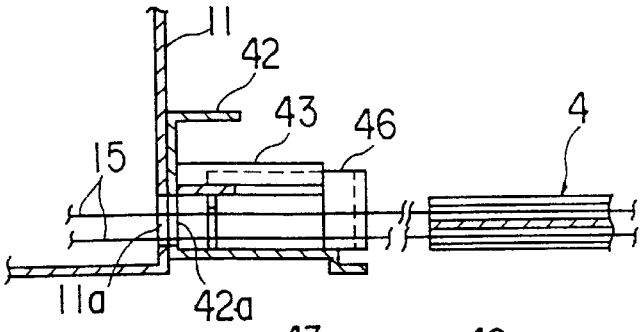
FIG. 8 is a longitudinal sectional view showing the tension adjusting means.
Figure 9:
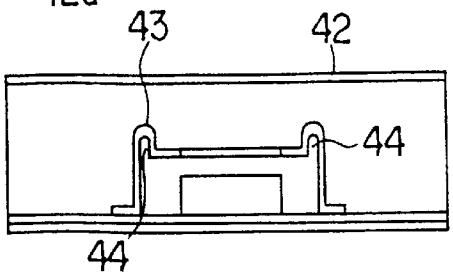
FIG. 9 is a front view showing a holding portion of the tension adjusting means.

Openings 42*a* and 11*a* are formed at positions corresponding to one another, respectively, on the back wall of the holding member 42 and the casing 11 of the drive device 10 on which the back wall is bonded, as shown in FIGS. 6 and 8. The belt 15 is inserted through the openings 42*a* and 11*a*.

One end surface of the guide rail 4 abuts on the middle part of the slide member 46. In this state, the tension of the belt 15 is applied the guide rail 4 in the direction represented by an arrow A in FIG. 1, the guide rail 4 slides in the direction of the arrow A by the tension, and the spring 48 is thereby compressed. That is, the guide rail 4 is held on the base body 1 to be elastically slidable by the spring 48.

Thus, if the length of the guide rail 4 longitudinally extends or contracts by the variation in the temperature or the like, the guide rail 4 slides while elastically displacing the slide member 46 of the tension adjusting means 41 in accordance with the extension and contraction and, therefore, the tension occurring at the belt 15 can be constantly maintained.

That is, when the guide rail 4 extends, it is possible to prevent the stress more than the necessary one from being applied to the guide rail 4. When the guide rail 4 contracts its length, it is possible to prevent the belt 15 from being loose. It is also possible to absorb the extension and contraction of the guide rail 4 caused by the difference in the diameters of the winding of the drive pulleys 14.

Figure 10:
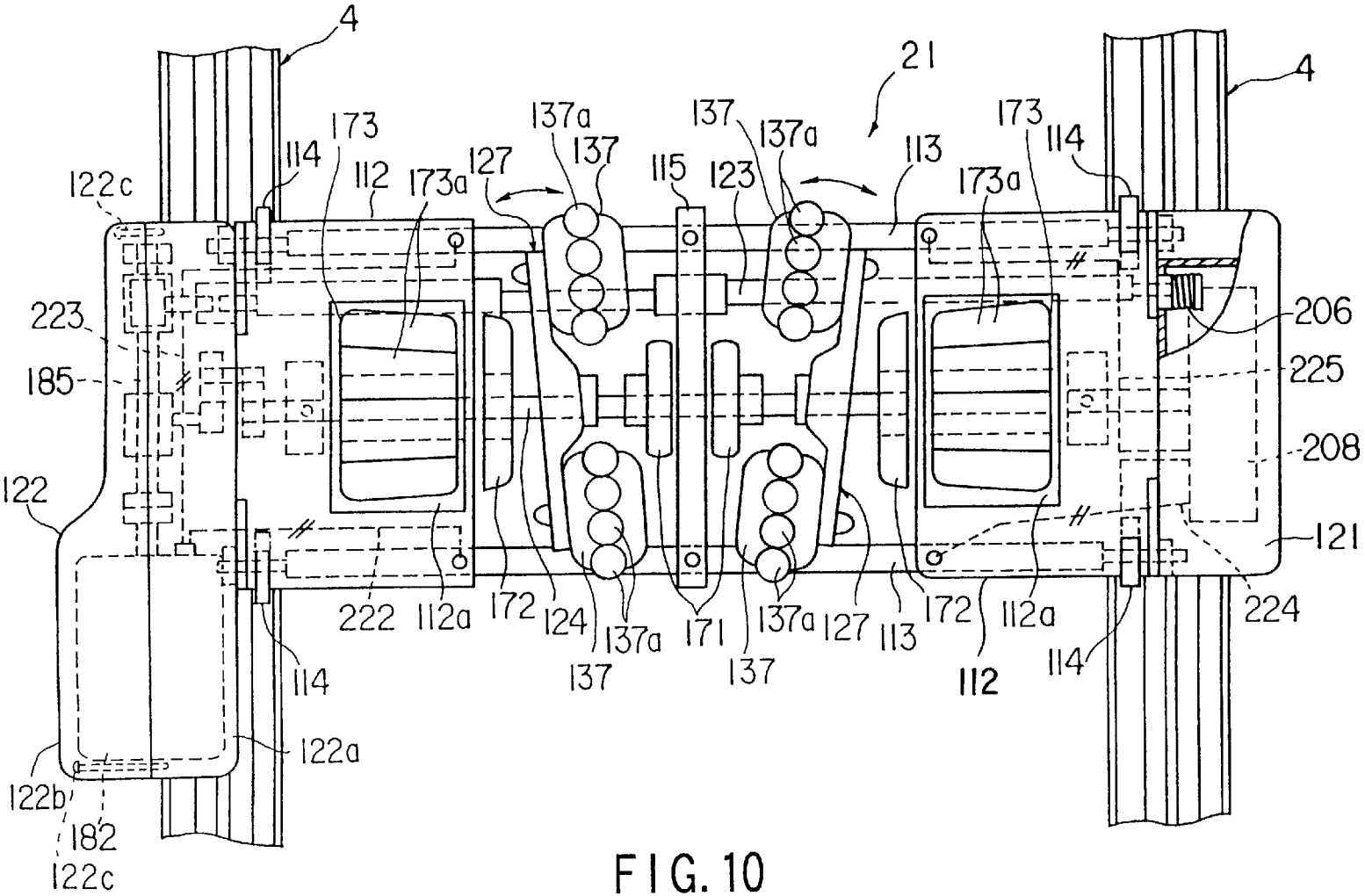
FIG. 10 is a plan view showing a holding body.
Figure 11:
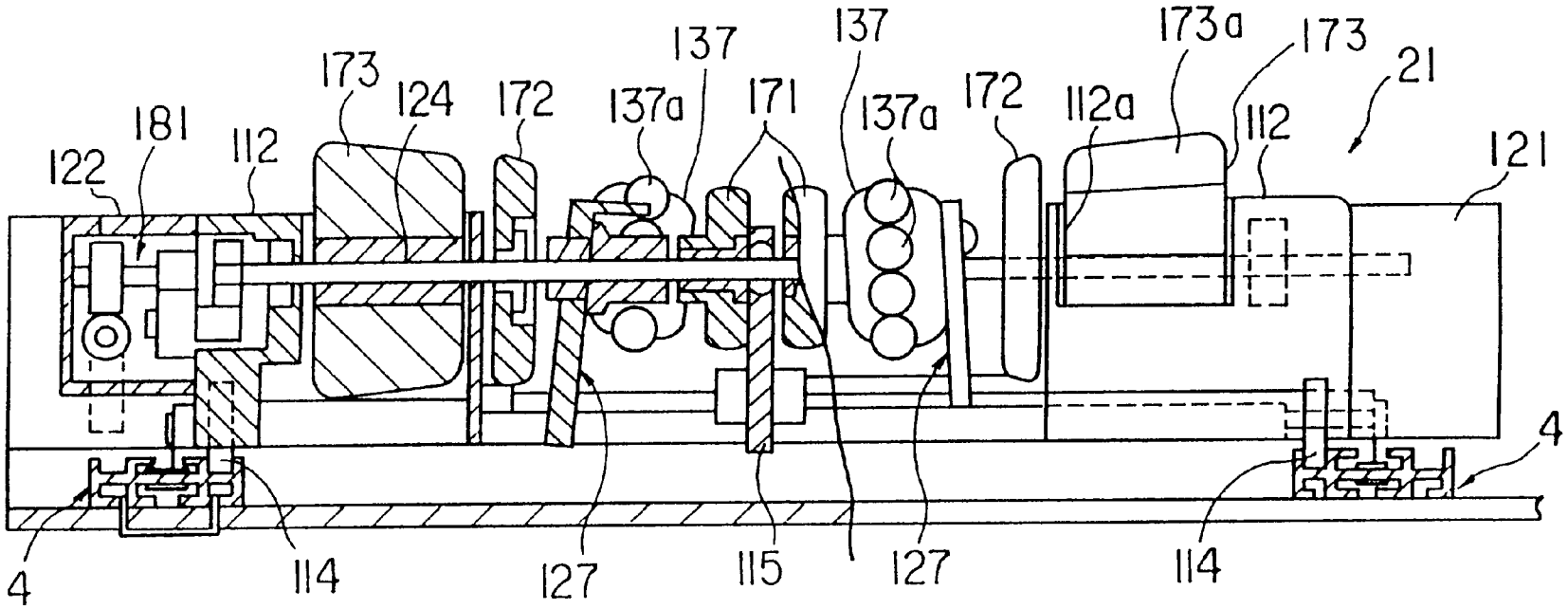
FIG. 11 is a longitudinal sectional view showing the holding body.
Figure 12:
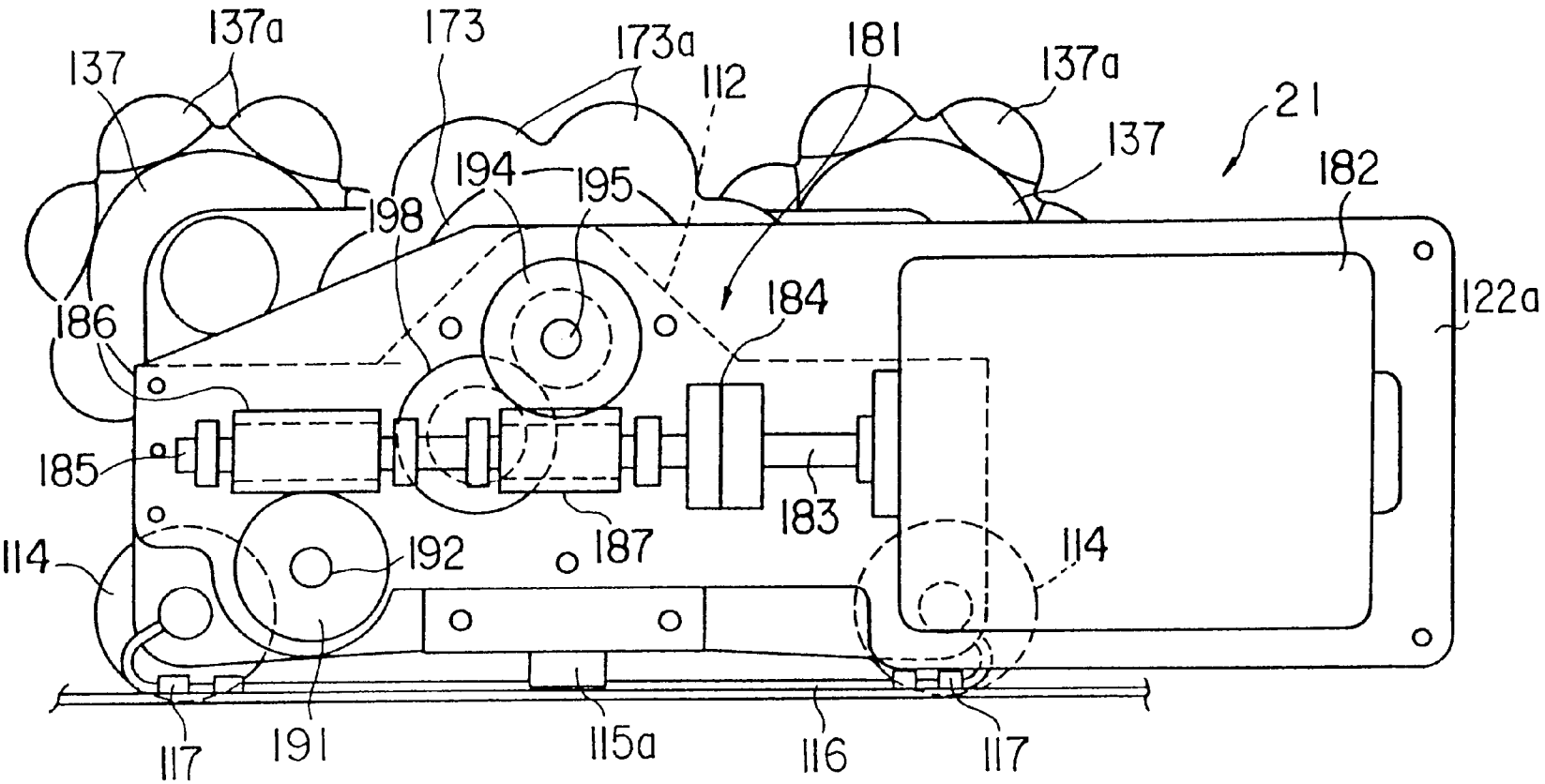
FIG. 12 is a side view showing the holding body, illustrating the interior of the power box.

The holding body 21 has a pair of side frames 112 formed of synthetic resin in a shape of a casing, with the lower surface opening, as shown in FIGS. 10 to 12. The bottom parts of both end portions in the running direction of the paired side frames 112 are coupled by coupling shafts 113, respectively.

Guide rollers 114 running on the running surfaces 4*e* formed on the guide rails 4 are provided respectively at both end portions of each of the paired coupling shafts 113 so as to be freely rotatable. A center frame 115, which has a side surface having a rectangular shape, is fixed at the middle portions of the coupling shafts 113 along the running direction of the side frames 112.

A holding member 115*a* is attached to the lower end of the middle part on the outer surface of the side frame 112 as shown in FIG. 12. A middle part of a wire 116 is inserted through the holding member 115*a* and thereby fixed. Both end portions of the wire 116 are led along the direction of the side portion of the side frame 112 and coupled to the belt 15 via coupling portions 117. The terminals of the end portions are coupled and fixed to the coupling shaft 113.

Thus, the holding body 21 interlocks the belt 15 via the wire 116 by driving the belt 15 to run. That is, the holding body 21 reciprocates along the guide rail 4.

As shown in FIG. 10, an electric component box 121 is attached to the outside surface of one of the side frames 112 so as to be freely detachable therefrom and a power box 122 is also attached to the outside surface of the other side frame 112 so as to be freely detachable therefrom. A first drive shaft 123 is rotatably provided at a lower part of one end side in the running direction, between the paired side frames 112 of the holding body 21, and a second drive shaft 124 is also rotatably provided at an upper part of the middle portion of the holding body 21.

The power box 122 is composed of a main body portion 122*a* whose side surface positioned at the laterally inner side of the holding body 21 is opened, and a lid portion 122*b* fixed bonded to the opening surface and fixed by screws 122*c*. The main body portion 122*a* is formed of aluminum die-casting or the like having a comparatively high heat conductivity, and the lid portion 122*b* is formed of synthetic resin.

Figure 16:
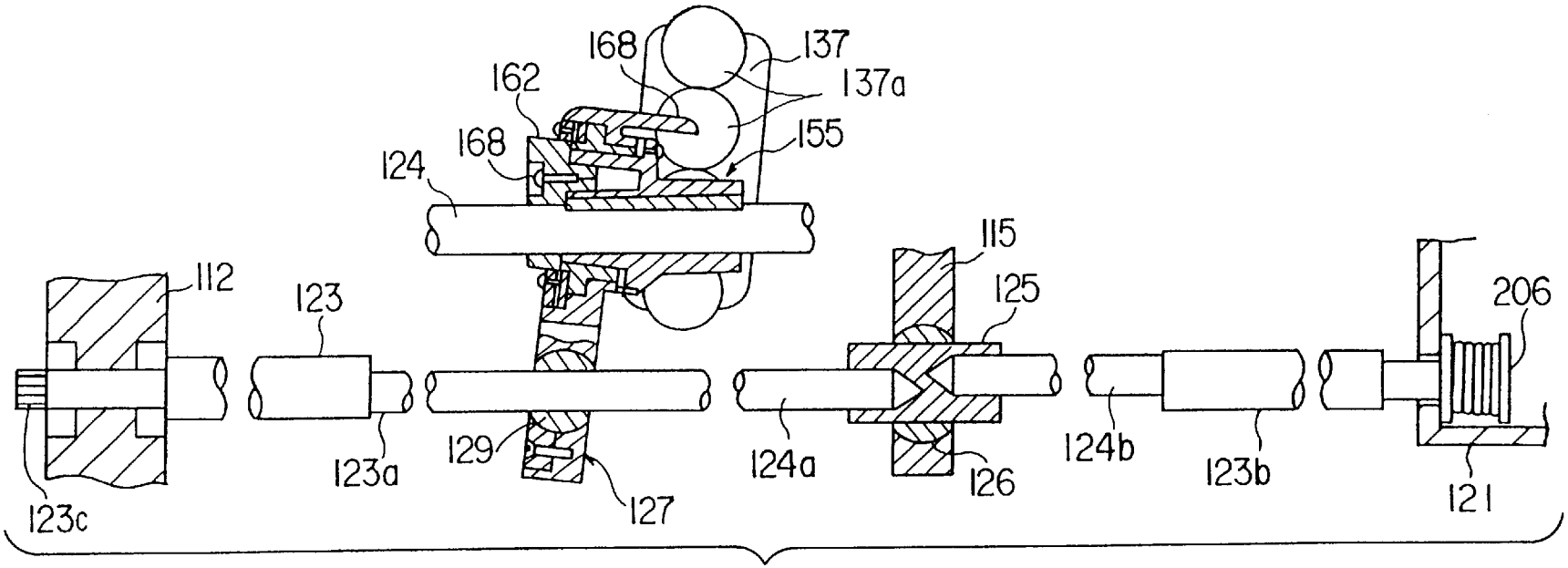
FIG. 16 is a front view showing a structure of the first drive shaft.

The first drive shaft 123 is divided into a first portion 123*a* and a second portion 123*b* at the middle part in the longitudinal direction of the shaft as shown in FIG. 16. A first eccentric shaft portion 124*a* and a second eccentric shaft portion 124*b* are provided at the first portion 123*a* and the second portion 123*b*, respectively. The eccentric shaft portion 124*a* and the eccentric shaft portion 124*b* are coupled while eccentric phases thereof are shifted from one another at 180 degrees by a joint 125, which connects top end portions of the eccentric shaft portion 124*a* and the eccentric shaft portion 124*b*. The joint 125 is rotatably supported at the center frame 115 by a first bearing 126.

Further, a proximal end portion of an arm 127 whose side surface is shaped in an L letter is coupled to each of the eccentric shaft portions 124*a* and 124*b* by a second spherical bearing 129 so as to be freely rotatable and slidable. That is, a pair of arms 127 are provided symmetrically around the center of the lateral direction of the holding body 21.

Figure 18:
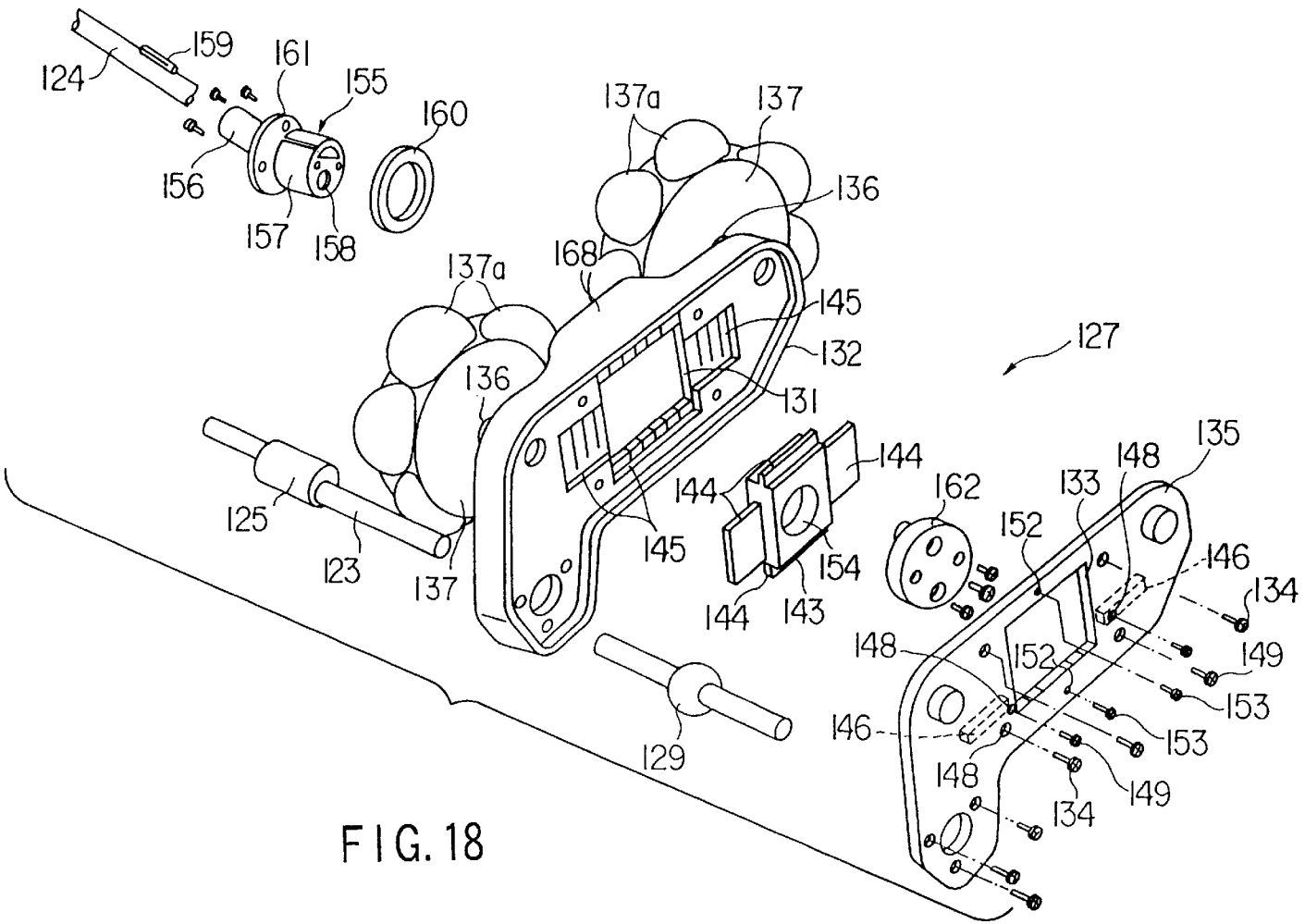
FIG. 18 is an exploded perspective view showing the arm.
Figure 20:
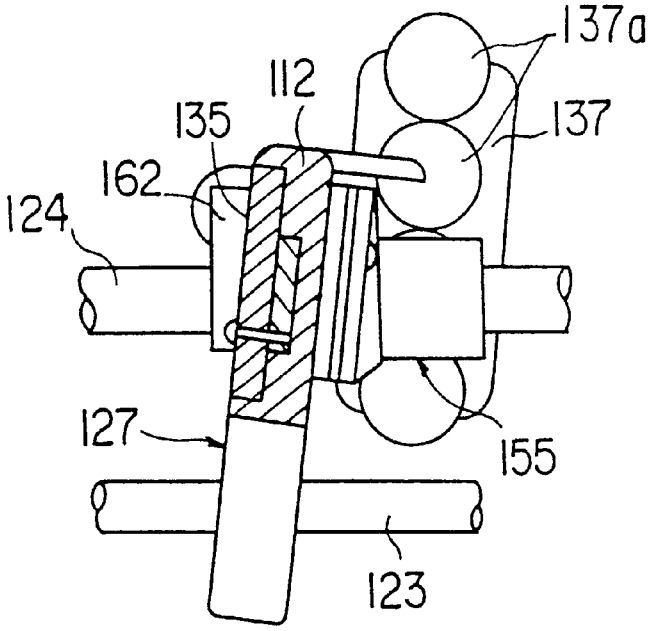
FIG. 20 is a sectional view as seen along a line XX—XX of FIG. 19.

As shown in FIG. 18, the arm 127 is composed of an arm housing 132 at which a first rectangular opening portion 131 is formed, and an arm cover 135 at which a second rectangular opening portion 133 is formed and which is bonded and fixed on one side surface of the arm housing 132 by screws 134. The arm housing 132 and the arm cover 135 are formed of synthetic resin such as polyacetals and the like.

A pair of support shafts 136 are molded to project integrally with a certain distance disposed therebetween, on the other side surface of the middle part and the top end part of the arm housing 132, i.e. on the part closer to the end than the proximal part when the proximal part is attached to the eccentric shaft portions 124*a* and 124*b*.

Figure 21:
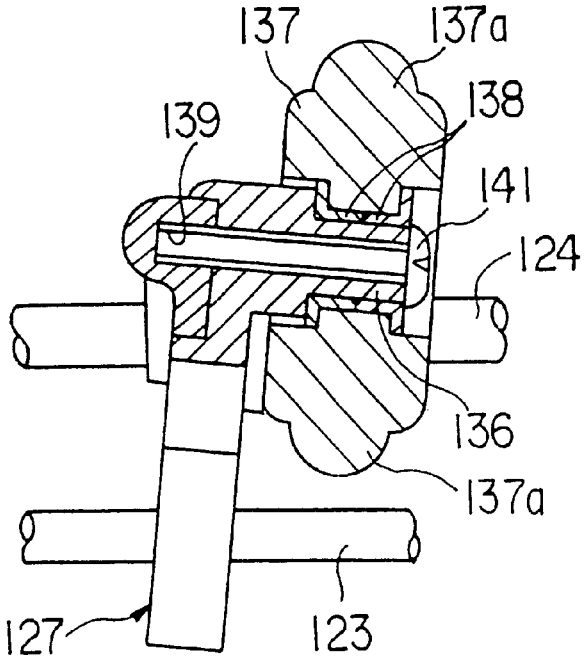
FIG. 21 is a sectional view as seen along a line XXI—XXI of FIG. 19.

A main massage roller 137, which has a plurality of semi-spherical projections 137*a* are provided on an outer peripheral surface thereof along the peripheral direction, is provided to be freely rotatable on the paired support shafts 136 via a bush 138 divided into two pieces, as shown in FIG. 21. The support shaft 136 passes into the main massage roller 137 and the main massage roller 137 is held by an attachment screw 141 engaged with a screw hole 139 formed on the arm cover 135 so as not to be detached from the support shaft 136.

Since the paired support shafts 136 are molded integrally with the arm housing 132 and the main massage rollers 137 are attached to the support shafts 136, the attachment to the support shafts 136 can be executed more easily than the other components. In addition, since the support shafts 136 are not loose to the arm housing 132, the main massage rollers 137 can be strictly attached.

Figure 22:
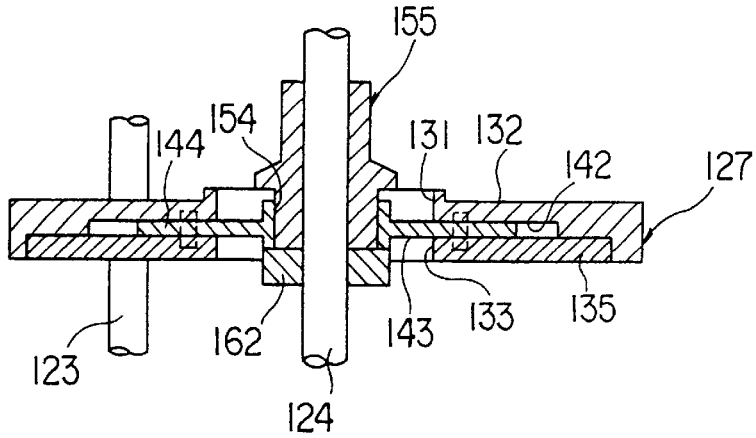
FIG. 22 is a sectional view as seen along a line XXII—XXII of FIG. 19.
Figure 23:
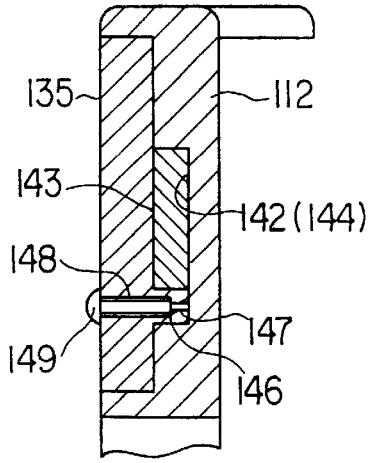
FIG. 23 is an enlarged sectional view showing a structure of a slot groove for vertically positioning a slider.

A holding portion 142 is formed between the surfaces of the arm housing 132 and the arm cover 135 as shown in FIGS. 22 and 23. A slider 143 is provided at the holding portion 142 so as to be freely slidable along the separating direction of the paired main massage rollers 137, i.e. the lateral direction.

Figure 24:
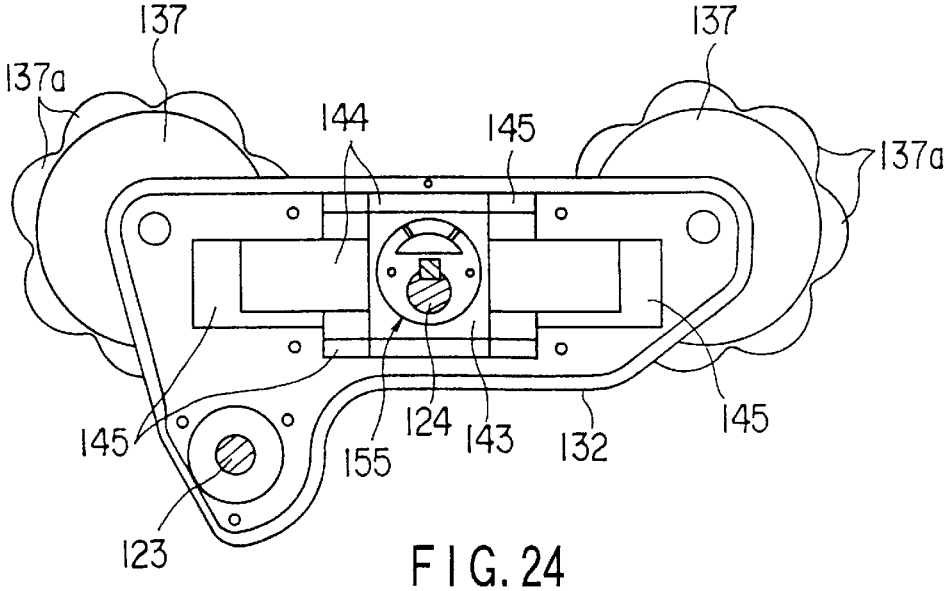
FIG. 24 is a front view showing the arm from which an arm cover is removed.
Figure 27A:
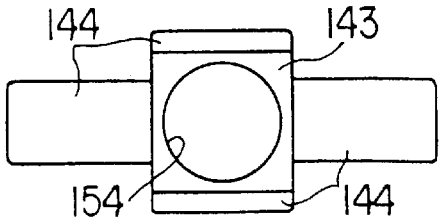
FIG. 27A is a front view showing the slider.
Figure 27B:
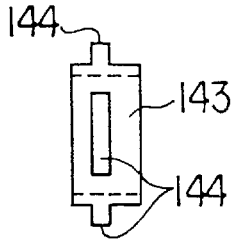
FIG. 27B is a side view showing the slider.

As shown in FIGS. 27A and 27B, the slider 143 is a rectangular metal plate. Guide elements 144 project from top and bottom end surfaces and both side surfaces of the slider 143. The guide elements 144 are slidably contained in recess portions 145 formed on both sides, and upper and lower ends of the first opening portion 131 on one side surface of the arm housing 132, as shown in FIG. 24.

Figure 26A:
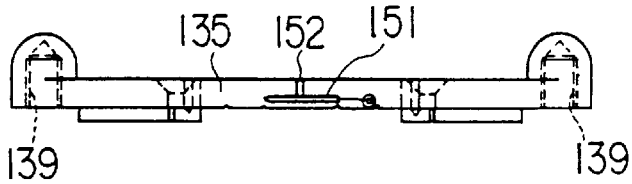
FIG. 26A is a plan view showing the arm cover.
Figure 26B:
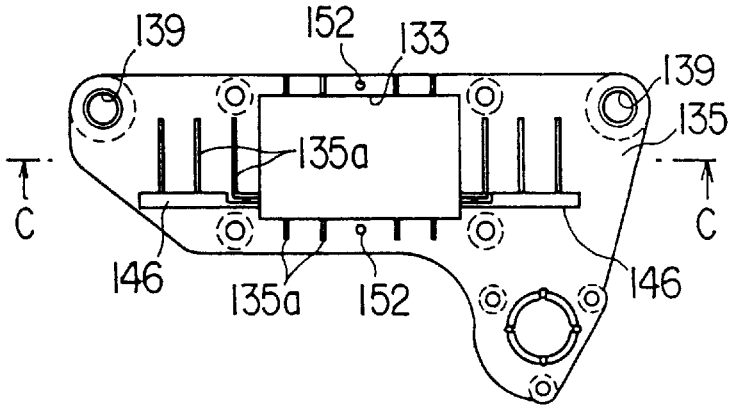
FIG. 26B is a front view.

A pair of strip-like receiving portions 146, which enter the lower parts of the recess portions 145 formed on both sides of the first opening portion 131 of the arm housing 132, are integrally formed to project, on the inner surface of the arm cover 135, as shown in FIGS. 23, 26A and 26B.

Figure 26C:
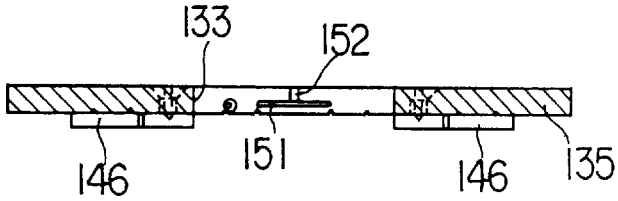
FIG. 26C is a sectional view as seen along a line C—C of FIG. 26B.
Figure 26D:
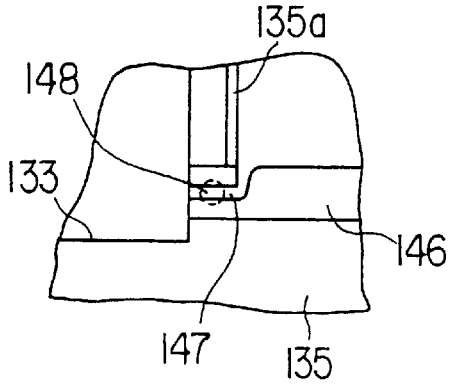
FIG. 26D is an enlarged view showing the slot groove for vertically positioning the slider.

First slot grooves 147 are formed on the receiving portions 146 as shown in FIGS. 23 and 26D. Screw holes 148 for communicating with the first slot grooves 147 are formed on the arm cover 135, and first deformation screws 149 (FIG. 18) are engaged with the screw holes 148.

When the first deformation screw 149 is engaged with the receiving portion 146, upper and lower parts of the receiving portion 146 divided by the first slot groove 147 expand in the vertical direction and pressurize the lower surface of the guide element 144 at the side of the slider 143. Thus, the vertically loose condition of the slider 143 in the holding portion 142 can be prevented.

Further, a second slot groove 151 is formed on each of the top and bottom end sides of the second opening portion 133 as shown in FIGS. 26A and 26C. Screw holes 152 for communicating with the second slot grooves 151 from the outer surface of the arm cover 135 are formed on the arm cover 135.

Second deformation screws 153 are engaged with the screw holes 152. Thus, the parts of the arm cover 135 at which the second slot grooves 151 are formed expand inwardly and pressurize the guide elements 144 provided on the upper and lower sides of the slider 143. Therefore, it is possible to prevent the slider 143 from being loose in the direction of thickness intersecting the sliding direction.

That is, the slider 143 is provided to be freely slidable without being loose in the longitudinal direction and the direction of thickness, by the first deformation screws 149 and the second deformation screws 153.

Figure 25A:
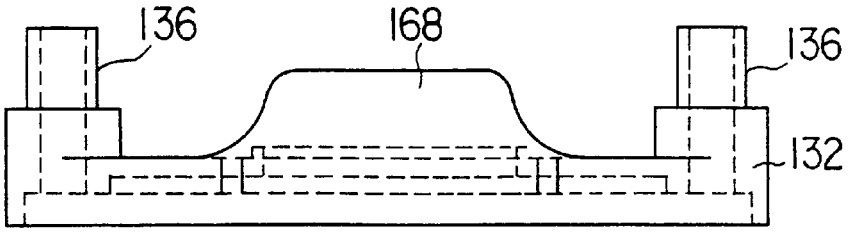
FIG. 25A is a plan view showing an arm housing.
Figure 25B:
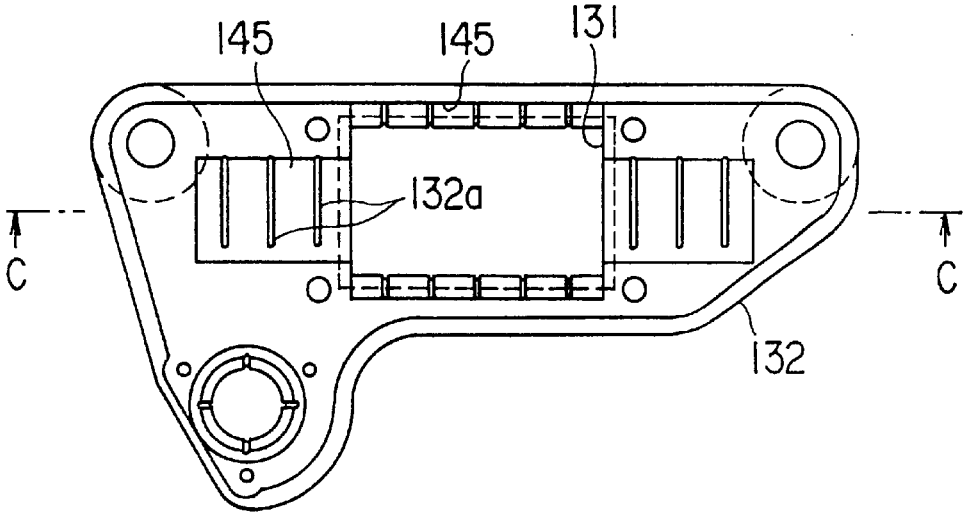
FIG. 25B is a front view showing the arm housing.
Figure 25C:
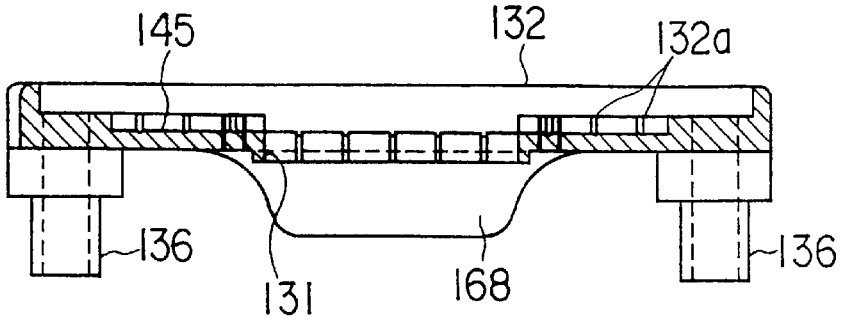
FIG. 25C is a sectional view as seen along a line C—C of FIG. 25B.

As shown in FIGS. 25A and 25B, oil storing grooves 132*a* are formed on the inner surfaces of the recess portions 145 formed on both side ends and the upper and lower ends of the first opening portion 131 of the arm housing 132. As shown in FIGS. 26A and 26B, oil storing grooves 135*a* are formed at parts facing the recess portions 145, on the inner surface of the arm cover 135. Lubricating oil is supplied into the oil storing grooves 132*a* and 135*a*.

Thus, the slider 143 provided to be slidable on the holding portion 142 can smoothly slide for a long time.

A fitting hole 154 is formed on the slider 143. The middle part of the second drive shaft 124 is inserted through the fitting hole 154. An eccentric cum body 155 is mounted on the middle part of the second drive shaft 124.

Figure 17:
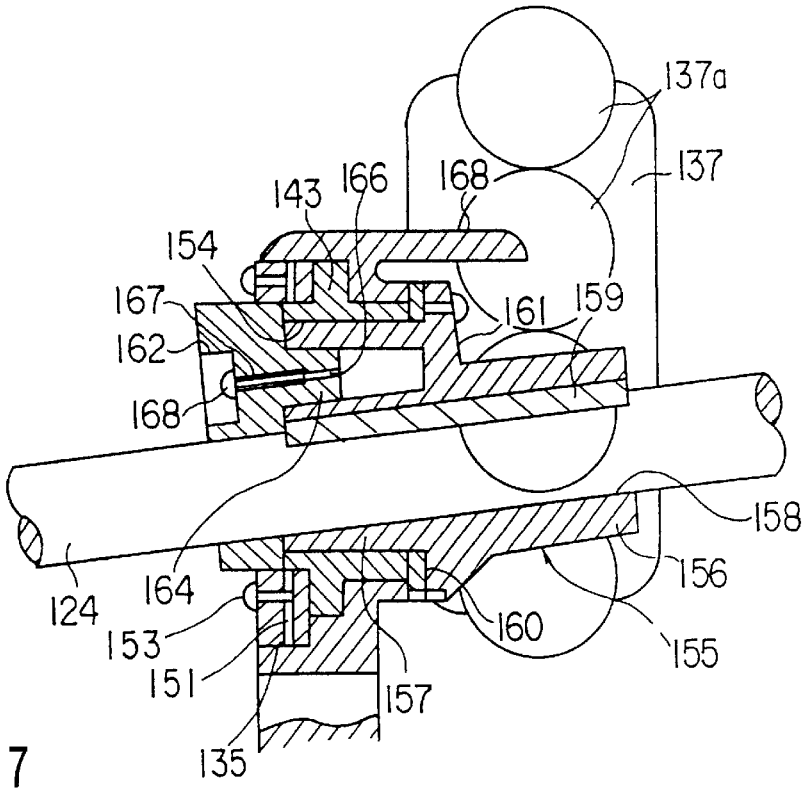
FIG. 17 is an enlarged sectional view showing an eccentric cum body provided on the second drive shaft.
Figure 19:
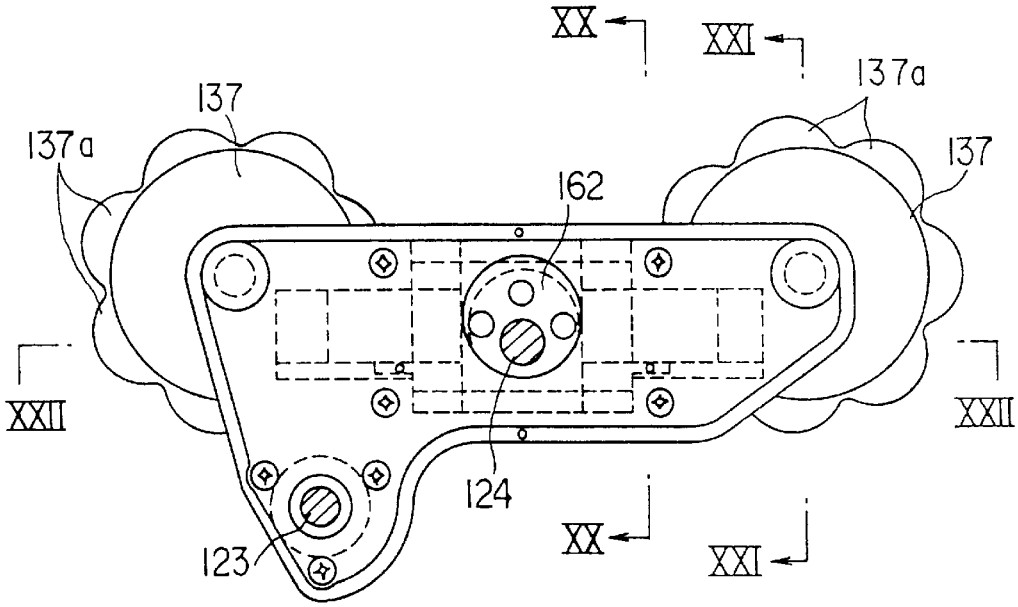
FIG. 19 is a front view showing the arm.

A boss portion 156 and an eccentric cum portion 157 are integrally formed by synthetic resin on the eccentric cum body 155 as shown in FIG. 28. A shaft hole 158 is formed at the eccentric cum body 155, and the second drive shaft 124 is inserted through the shaft hole 158. A key 159 is provided between the shaft hole 158 of the eccentric cum body 155 and the second drive shaft 124 as shown in FIG. 17.

The eccentric cum portion 157 is eccentric to the axis of the second drive shaft 124 and is inclined at a predetermined angle as shown in FIG. 28. A collar portion 161 is formed on one side of the eccentric cum portion 157. The eccentric cum portion 157 is engaged with the fitting hole 154 through a thrust washer 160 (FIG. 18).

A cum pressing member 162 of synthetic resin is bonded and fixed to an end surface of the eccentric cum portion 157. The slider 143 is sandwiched between the cum pressing member 162 and the collar portion 161. The cum pressing member 162 is formed to have a diameter greater than the diameter of the eccentric cum portion 157.

Figure 28A:
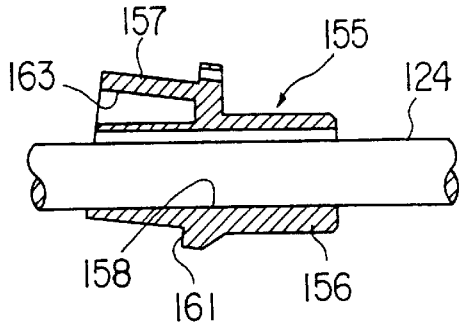
FIG. 28A is a sectional view showing an eccentric cum body.
Figure 28B:
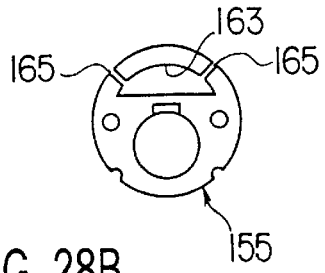
FIG. 28B is a side view showing the eccentric cum body.
Figure 29:
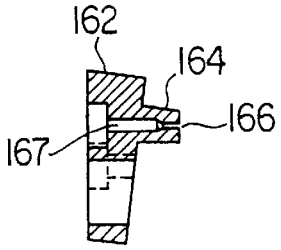
FIG. 29 is a sectional view showing a cum pressing portion attached to the eccentric cum body.

A recess portion 163, which opens to the end surface of the eccentric cum portion 157, is formed on the end surface thereof as shown in FIGS. 28A and 28B. A projecting portion 164, which is fitted in the recess portion 163, is provided on the cum pressing member 162 as shown in FIG. 29.

Split grooves 165 are formed along the longitudinal direction of the shaft, on the peripheral wall of the recess portion 163 of the eccentric cum portion 157. A third slot groove 166 is formed in the projecting portion 164. Further, a screw hole 167 communicating with the third slot groove 166 is formed in the cum pressing member 162. A third deformation screw 168 is engaged with the screw hole 167 as shown in FIG. 17.

Thus, the projecting portion 164 expands laterally, presses the peripheral wall of the recess portion 163 which is split by the split grooves 165, outwardly in the radial direction, and makes the peripheral wall contact the inner peripheral surface of the fitting hole 154 of the slider 143. Therefore, the eccentric cum body 155 can be fitted in the fitting hole 154 of the slider 143 without being loose.

The second drive shaft 124 is driven to rotate as described later. Then, the paired main massage rollers 137 revolve vertically in accordance with the eccentricity and the angle of inclination of the eccentric cum body 155, and the arm 127 pivots in the direction represented by an arrow in FIG. 10. For this reason, the paired main massage rollers 137 provided on each arm 127 execute the kneading movement.

At this time, since the slider 143 slides to the arm 127 in accordance with the eccentric rotation of the eccentric cum portion 157, the pivoting movement of the paired arms 127 is smoothly executed.

At the upper part of the arm housing 132 of the arm 127, a covering portion 168 for covering the upper side of the eccentric cum body 155 projecting from the opening portion 131 is provided. Thus, it is possible to prevent the user's body from abutting on the eccentric cum body 155.

On the second drive shaft 124, a pair of center rollers 171 positioned at both sides of the center frame 115, a pair of side rollers 172 positioned in the vicinity of the inner surfaces of the respective side frames 112, and a pair of auxiliary massage rollers 173 contained in container portions 112*a* formed to open to the upper surface of the side frames 112, are provided to be freely rotatable, as shown in FIGS. 10 and 11. A plurality of projections 173*a* in a semi-columnar shape are provided on the outer peripheral surface of the auxiliary massage rollers 173, in the peripheral direction.

The center rollers 171 prevent the user's body, particularly the neck from abutting on the center frame 115, and the side rollers 172 prevents the neck from abutting on the inner edges of the side frames 112. Further, the semi-columnar projections 173*a* of the auxiliary massage rollers 173 are formed in a taper shape which is inclined downwardly to the inside of the holding body 21 in the lateral direction. It is thereby possible to massage the user's back, prevent the user's body from displacing in the lateral direction by the tapered surface, and prevent the body from abutting on the top surfaces of the side frames 112.

The main massage rollers 137 and the auxiliary massage rollers 173 are formed by foaming urethane resin. Thus, the massage rollers 137 and 173 are set to have a predetermined hardness by adjusting the magnification of foaming at the foaming time. In this embodiment, the hardness of the massage rollers 137 and 173 is set to be in a range from 20 to 50, preferably 30 to 50, as measured by a rubber hardness meter adopting the spring type hardness test A based on the JIS physical testing method of vulcanized rubber.

An end portion of the first drive shaft 123 and an end portion of the second drive shaft 124 project into the power box 122. A second drive mechanism 181 is provided inside the power box 122. The first drive shaft 123 and the second drive shaft 124 are selectively driven to rotate by the second drive mechanism 181.

Figure 13:
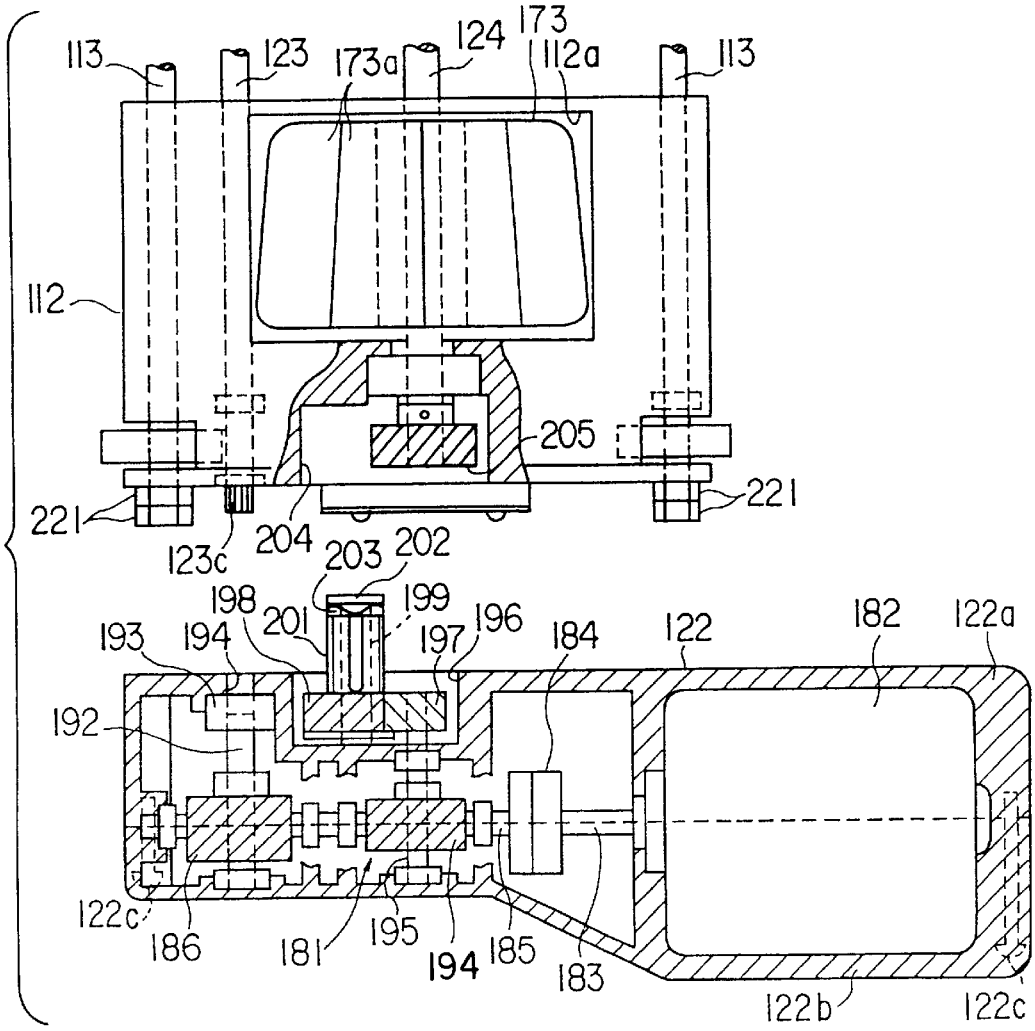
FIG. 13 is a plan view showing a state in which the power box of the holding body is separated from a side frame.
Figure 14:
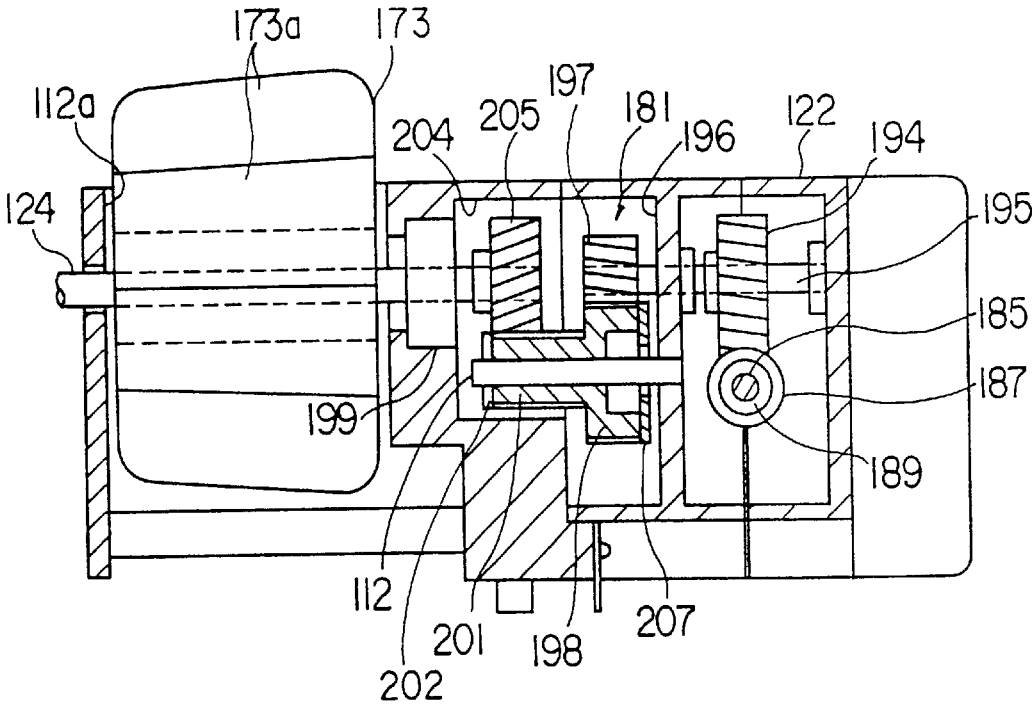
FIG. 14 is a sectional view showing the power box in the holding body.

The second drive mechanism 181 has a reversible motor 182 contained in the power box 122 as shown in FIGS. 12 and 13. A rotating shaft 185 provided to be freely rotatable inside the power box 122 is coupled to an output shaft 183 of the reversible motor 182 via a joint 184.

Figure 15:
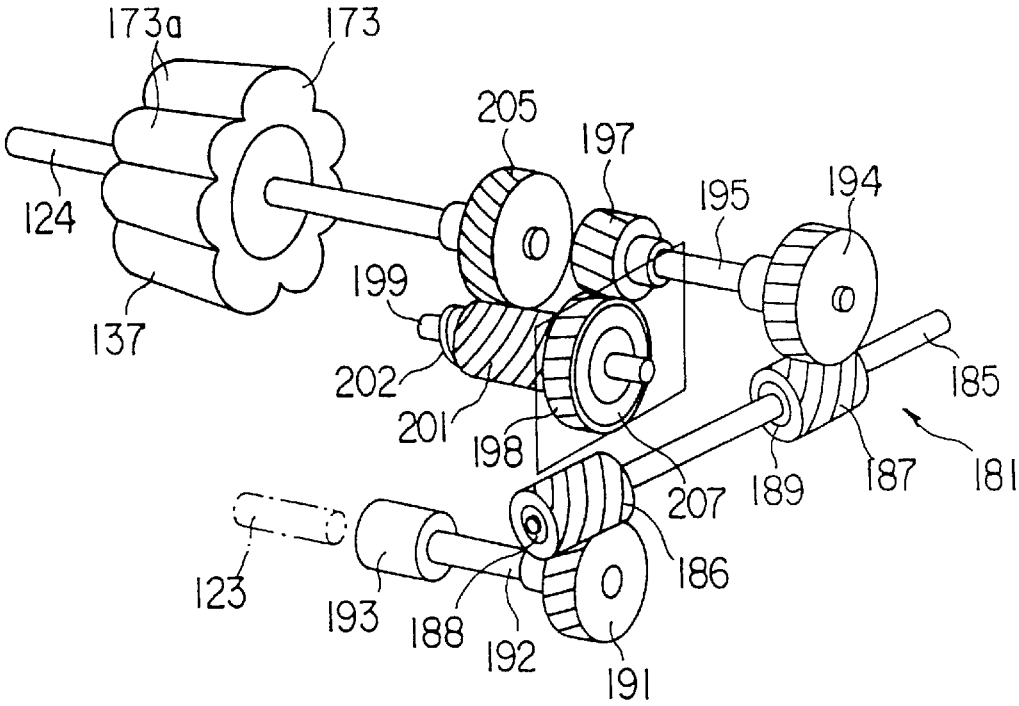
FIG. 15 is a perspective view schematically showing a second drive mechanism for driving a first drive shaft and a second drive shaft.

A first worm gear 186 and a second worm gear 187 are provided on the rotating shaft 185. As shown in FIG. 15, the first worm gear 186 can be rotated in one way by a first one-way clutch 188 and the second worm gear 187 can be rotated in the way opposite to the way of rotation of the first worm gear 186 by a second one-way clutch 189.

A first worm wheel 191 engages with the first worm gear 186. The first worm wheel 191 is attached to a first support shaft 192 provided to be freely rotatable at one end inside the power box 122.

An end portion of the first support shaft 192 is coupled to a coupling 193 provided to be freely rotatable on the sidewall of the power box 122, as shown in FIG. 13. The coupling 193 faces a through hole 194 formed on the sidewall.

When the power box 122 is bonded to one of the side frames 112, one end portion of the first drive shaft 123 enters the power box 122 through the through hole 194 and is coupled to the first support shaft 192 via the coupling 193 to rotate integrally therewith. This coupling can be implemented by, for example, forming splines on the inner peripheral surface of the coupling 193 and also forming splines 123*c* on the end portion of the first drive shaft 123 as shown in FIG. 13.

Therefore, the one-way rotation of the output shaft 183 of the reversible motor 182 is transmitted to the first drive shaft 123 via the first worm gear 186 and the worm wheel 191. The first worm gear 186 and the worm wheel 191 constitute a first power transmission mechanism.

A second worm wheel 194 engages with the second worm gear 187. The second worm wheel 194 is attached to the end portion of a second support shaft 195 supported to be freely rotatable inside the power box 122. The other end portion of the second support shaft 195 projects into a recess portion 196 formed on one side of the power box 122 and the projecting end portion is fitted in a first helical gear 197.

A second helical gear 198 engages with the first helical gear 197. The second helical gear 198 is provided to be freely rotatable and slightly move in the longitudinal direction of the shaft, on a third support shaft 199 which projects from the outer surface of the sidewall of the power box 122 forming the recess portion 196.

An intermediate gear 201 composed of a helical gear formed integrally with the second helical gear 198 is provided on the third support shaft 199. A stopper 202 such as a C ring and a wave washer 203 are provided at the tip end of the third support shaft 199 and the second helical gear 198 is pushed by the wave washer 203 in the longitudinal direction of the shaft.

When the power box 122 is bonded to the side surface of one of the side frames 112, the intermediate gear 201 enters a recess portion 204 formed on the side surface of the side frame 112. An end portion of the second drive shaft 124 projects into the recess portion 204 and the projecting end portion is fitted in a terminal gear 205, which is composed of a helical gear. The intermediate gear 201 engages with the terminal gear 205.

Thus, when the rotating shaft 185 is driven to rotate in the way opposite to the one way as described above by the reversible motor 182, the rotation is transmitted to the second drive shaft 124 via the second worm gear 187, the second worm wheel 194, the first and second helical gears 197 and 198, the intermediate gear 201 and the terminal gear 205.

These gear rows that transmit the power to the second drive shaft 124 constitutes a second power transmission mechanism. With this constitution, the transmission of the power to the second drive shaft 124 can be implemented certainly in a simple structure, and it is possible to reduce the speed at two stages and coaxially arrange the second support shaft 195 and the second drive shaft 124. Particularly, the number of components can be reduced by integrally forming the second helical gear 198 and the intermediate gear 201.

A spring clutch 206 serving as a third one-way clutch is provided at the other end portion, i.e. the end portion projecting into the other side frame, of the first drive shaft 123, as shown in FIGS. 10 and 16. When the first drive shaft 123 does not rotate, the spring clutch 206 restricts the first drive shaft 123 from rotating in a way opposite the one way, which is the rotating way of the first drive shaft 123.

Further, a sheet-like friction member 207, which is formed of a material such as polyacetals, is applied to one side surface of the second helical gear 198. The friction member 207 is in small contact with an outer surface (fixed member) of the sidewall of the recess portion 196 at the power box 122.

The load in the longitudinal direction of the shaft is applied to the second helical gear 198 engaging with the first helical gear 197 driven to rotate by the reversible motor 182, in the direction of being remote from the outer surface of the sidewall, in accordance with the facing way of the gear teeth. However, the load in the direction opposite thereto is applied to the second helical gear 198 by the wave washer 203 and, therefore, the friction member 207 provided at the second helical gear 198 is kept to be in a small contact with the outer surface of the sidewall.

The friction member 207, which is pushed on the outer surface of the sidewall, reduces the speed of the rotation of the second drive shaft 124. That is, in a case where the eccentric cum body 155 rotates in synchronization with the rotation of the second drive shaft 124, it gradually rotates against the user's load applied to the main massage roller 137 when it comes from the bottom dead center of eccentric cum portion 157 to the top dead center thereof.

However, when the eccentric cum body 155 passes the top dead center, it is to radically rotate since the user's load is applied to the eccentric cum body 155 via the main massage roller 137. At this time, the rotation of the second drive shaft 124 interlocking with the rotation of the eccentric cum body 155 is transmitted to the second helical gear 198 in the direction opposite to the direction of power transmission from the first helical gear 197.

When power is transmitted from the first helical gear 197 to the second helical gear 198, the load in the longitudinal direction is applied to the second helical gear 198 in the direction of being remote from the outer surface of the sidewall. However, in a case where the rotation of the second drive shaft 124 is transmitted in the opposite direction, the load in the longitudinal direction of approaching the outer surface of the sidewall is applied to the second helical gear 198. Further, since the second helical gear 198 is pushed toward the sidewall by the wave washer 203, the second helical gear 198 slightly moves along the third support shaft 199 and the friction member 207 provided on the side surface thereof is pushed on the outer surface of the sidewall of the recess portion 196.

Accordingly, since the second drive shaft 124 is prevented from rotating radically, the main massage roller 137 is prevented from radically falling together with the arm 127 and thus preferable massaging can be obtained.

Electricity is fed to the reversible motor 182 provided in the power box 122 of the holding body 21 and also to an electric component 208 (FIG. 10) provided in the electric component box 121 via a pair of belts 15 driven to run under the holding body 21.

That is, as shown in FIG. 6, a pair of holders 212 (one of them shown) having conductive brushes 221, which are in electric contact with the belts 15, are fixed on the end portions of the paired guide rails 4 by screws 213. Lead wires 214 are connected to the conductive brushes 221. One of the lead wires 214 is connected to the positive side of the DC power supply (not shown) and the other is connected to the negative side thereof.

Figure 3:
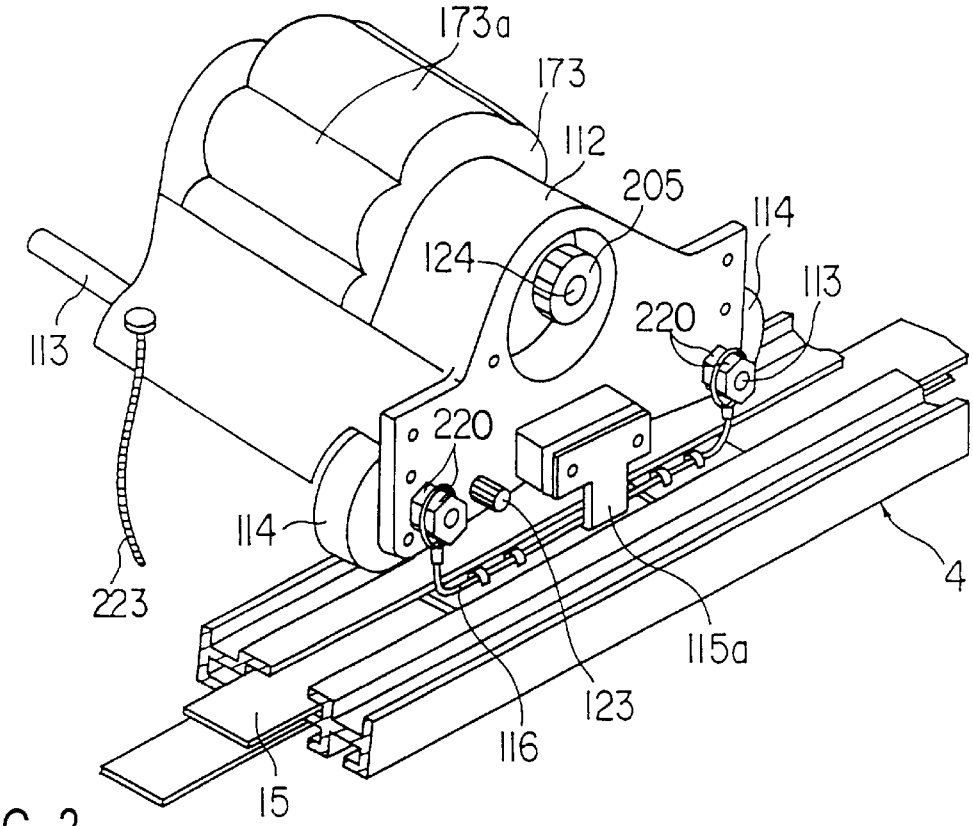
FIG. 3 is a perspective view showing coupling structure of a holding body from which a power box is removed and a belt.

Each of the belts 15 is electrically conductive with the side frame 121 of the holding body 21 via the coupling portions 117 and the wire 116 that make the holding body 21 interlock with the belt 15, as shown in FIG. 3.

Both ends of the wire 116 are fixed to the ends of the paired coupling shafts 113 connected to the paired side frames 121, by nuts 220. The nut 220 provided at one end of one of the coupling shafts 113 and the nut 221 provided at the other end of the other coupling shaft 113 are formed of an electrically insulating material such as synthetic resin or the like. The other nuts 220 are formed of a metal, which is an electrically conductive material.

Thus, one of the belts 15 is electrically connected to the coupling shaft 113 via the metal nuts 220 provided at one end of one of the wires 116 and one end of the coupling shaft 113. The other belt 15 is electrically connected to the other coupling shaft 113 via the metal nuts 220 provided at one end of the other wire 116 and one end of the other coupling shaft 113.

As shown in FIG. 10, one end of one of the coupling shafts 113 and the reversible motor 182 are connected to one another by a first lead wire 222, and one end of the other coupling shaft 113 the reversible motor 182 are connected to one another by a second lead wire 223.

The other end of the above one coupling shaft 113 and the electric component 208 provided in the electric component box 121 are connected to one another by a third lead wire 224, and the other end of the other coupling shaft 113 and the electric component 208 are connected to one another by a fourth lead wire 225.

Thus, electricity is fed to the reversible motor 182 and the electric component 208. That is, even when the reversible motor 182 is provided in the holding body 21 driven to run which allows the main massage roller 137 to make kneading and pounding movements, electricity can be fed to the reversible motor 182 by using the belts 15 which make the holding body 21 run.

Figure 30:
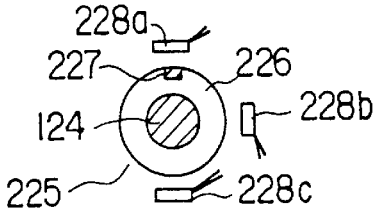
FIG. 30 is an explanatory view showing a mechanism for sensing the rotation angle of the second drive shaft.

A sensor mechanism 225 for sensing the eccentric position of the eccentric cum portion 157 of the eccentric cum body 155 is provided at the other end portion of the second drive shaft 124, which projects into the electric component box 121. The sensor mechanism 225 has a disk 226 in which the end portion of the second drive shaft 124 is fitted as shown in FIG. 30. A magnet 227 is embedded in the disk 226, corresponding to the position (top fulcrum) where the eccentricity of the eccentric cum portion 157 is largest.

First to third sensors 228*a* to 228*c* for sensing the magnetic force are arranged around the disk 226, and shifted at 90 degrees in the peripheral direction. That is, the sensors are arranged vertically and one of the directions at right angles with the vertical direction. When the magnet 227 faces the sensors 228*a* to 228*c*, they sense the magnetic force thereof. Therefore, they can sense the rotation angle corresponding to the eccentricity of the eccentric cum portion 157. Thus, the rotation angle of the second drive shaft 124 can be controlled at an angle at which the magnet 227 faces each of the sensors 228*a* to 228*c*.

Figure 31A:
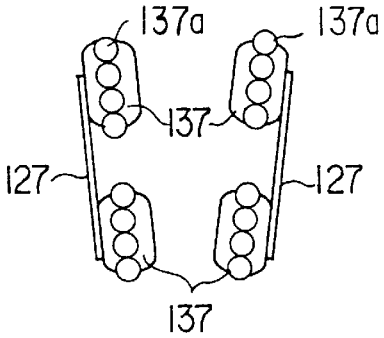
FIGS. 31A to 31C are explanatory views showing the rotation angle of the second drive shaft and an inclined state of a pair of arms.
Figure 31B:
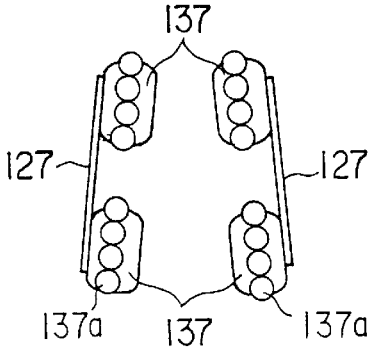
Figure 31C:
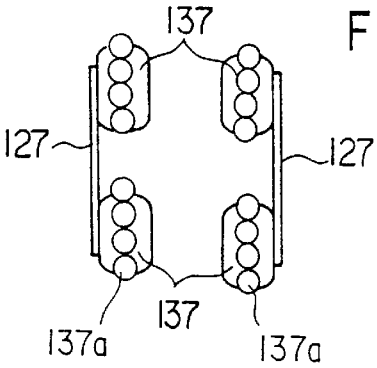

The arms 127 pivot by the rotation of the second drive shaft 124. By controlling the rotation angle, the pivoting state as seen in the plane of the paired arms 127 can be set to be open at the top, open at the back or parallel, as shown in FIGS. 31A to 31C.

The above-described embodiment employs the sensors of the magnetic force type using the magnets. However, the sensors of the photoelectric type may be employed.

Next, use of the massage apparatus having the above-described structure will be explained.

When the user lies down on the exterior cover 20 that covers the holding body 21 on the base 1, the drive device 10 is operated. Thus, since the holding body 21 reciprocates along the rails 2, massaging can be provided to the user's back by the main massage rollers 137 and the auxiliary massage rollers 173 provided in the holding body 21.

Two main massage rollers 137 are provided at each of a pair of arms 127. Therefore, the massaging force is larger than that in a case where only one massage roller 137 is provided thereat, and in accordance with this the massaging effect can be enhanced.

Two main massage rollers 137 are provided on one arm 127 along the running direction of the holding body 21, with a predetermined distance disposed therebetween. The user's body hardly falls in that direction. In addition, the user's body hardly falls in the lateral direction of the holding body 21 by providing the auxiliary massage rollers 173 outside the main massage rollers 137. Further, the center rollers 171 are provided on the second drive shaft 124, on both sides of the center frame 115 and the side rollers 172 are provided thereon on the inner side of the side frames 112. Further, the cover portion 168 for covering the eccentric cum body 155 provided at the arm 127 is provided on the arm 127.

Therefore, these rollers and the cover portion 168 prevent the body of the user lying on the base 1 from falling into the holding body 21. Therefore, the use's body is not strictly rubbed by the holding body 21 driven to run. Further, since it is possible to prevent the user's body from abutting on the holding body 21 without making the diameter of the massage roller 31 larger, the thickness of the massage apparatus is not increased.

The main massage rollers 137 and the auxiliary massage rollers 173 are formed by subjecting urethane resin to foam molding. For this reason, they have a desirable hardness and an outer skin is formed on the surface thereof by setting the magnification of foaming at the foam molding time. Therefore, the abrasion resistance can be improved by this outer skin. Further, since they have a desirable harness in accordance with the foaming rate, a plasticizer does not need to be used as the prior art. The massage rollers 137 and 173 having high abrasion resistance can be therefore obtained.

In this embodiment, the hardness of the massage rollers 137 and 173 is set to be in a range from 20 to 50, preferably 30 to 50, as measured by a rubber hardness meter adopting the spring type hardness test A based on the JIS physical testing method of vulcanized rubber.

Thus, the massage rollers 137 and 173 are not too hard to give pain to the user or not too soft to achieve the massaging effect.

Two main massage rollers 137 are provided at the middle portion and the top end portion of the arm 127, that are closer to the head side than the proximal end part, and are supported on the second drive shaft 124 by means of the slider 143 that is held to be freely slidable at the middle part of the arm 127.

Therefore, if the first drive shaft 123 is driven to make the main massage rollers 137 execute the pounding movement while the user's load is applied to the main massage rollers 137, the rotation moment occurs at the arm 127 around the second drive shaft 124 serving as a fulcrum, as a difference between a product of the distance from the center of the drive shaft 124 to the attachment portion of the main massage roller 137 provided at the top end portion and the load applied to the main massage roller 137 at the top end portion, and a product of the distance from the center of the drive shaft 124 to the attachment portion of the main massage roller 137 provided at the middle portion and the load applied to the main massage roller 137 at the middle portion.

To drive the first drive shaft 123, the torque obtained by dividing the value of the rotation moment occurring at the arm 127 by the distance from the second drive shaft 124 serving as the fulcrum to the first drive shaft 123 may be applied to the first drive shaft 123.

That is, the first drive shaft 123 can be driven by a small power as compared to a case where one main massage roller 137 is provided on the top end side of the arm 127. In a case where the second drive shaft 124 is driven to make the kneading movement, too, it can be driven by a small torque. For this reason, the reversible motor 182 for driving the first and second drive shafts 123 and 124 can be miniaturized.

On the other hand, if the reversible motor 182 provided in the holding body 21 is operated to rotate the rotating shaft 185, for example, one direction (normal direction), only the first drive shaft 123, of the first and second drive shafts 123 and 124, can be rotated in a determined direction.

Thus, the paired arms 127 can be vertically displaced by the eccentric rotation of the first eccentric shaft portion 124*a* and the second eccentric shaft portion 124*b* of the first drive shaft 123. Therefore, the pounding movement can be assigned to the main massage rollers 137.

If the rotating shaft 185 is rotated in a reverse direction by the reversible motor 182, only the second drive shaft 124 is rotated. The arms 127 are thereby driven to pivot and, therefore, the kneading movement can be assigned to the main massage rollers 137 provided on the paired arms 127.

The pounding and kneading movements can be made by the main massage rollers 137 while reciprocating the holding body 21. That is, since the drive device 10 is provided in the base 1 and the reversible motor 182 is provided in the holding body 21, either the pounding movement or the kneading movement can be selectively assigned to the main massage rollers 137 while making the holding body 21 run if both the drive device 10 and the reversible motor 182 are operated.

If the drive device 10 is operated in a state in which the operation of the reversible motor 182 is stopped, the holding body 21 can be made to run and rolling massage can be thereby provided by the main massage rollers 137. In addition, if the reversible motor 182 is operated while the operation of the drive device 10 is stopped, either the pounding movement or the kneading movement can be assigned to the main massage rollers 137. Thus, two main massage rollers 137 are provided on each of the paired arms 127 and, therefore, the pounding movement and the kneading movement can be made at four points and preferable massaging can be effectively provided.

Reversibly, if either the drive device 10 or the reversible motor 182 is operated, either the pounding movement or the kneading movement can be assigned to the main massage rollers 137 when the holding body 21 is made to run or while the operation of the holding body 21 is stopped.

The reversible motor 182 and the second drive mechanism 181 for selectively rotating the first drive shaft 123 and the second drive shaft 124 by the reversible motor 182 are provided in the power box 122 of the holding body 21.

For this reason, the overall structure can be made compact as compared to a case where the reversible motor 182 is provided separately from the holding body 21. Moreover, although the reversible motor 182 is provided in the holding body 21 driven to run, electricity can be fed to the reversible motor 182 by means of a pair of belts 15 for allowing the holding body 21 to run and, therefore, the structure for the feeding can also be simplified.

The spring clutch 206 is provided at the end portion of the first drive shaft 123 which projects into the electric component box 121. When the first drive shaft 123 is stopped, the spring clutch 206 restricts the first drive shaft 123 from rotating in a direction opposite to the above-described determined direction.

When the first drive shaft 123 is stopped and then the second drive shaft 124 is rotated to allow the main massage rollers 137 to make the kneading movement, the first drive shaft 123 sometimes rotates slightly in the direction opposite to the determined direction of rotation in accordance with the movement of the pivoting arms 127. Then, the vertical movement around the proximal end part serving as a fulcrum is applied to the arms 127 as well as the pivoting movement made by the second drive haft 124 and, therefore, preferable kneading massage cannot be made.

However, the spring clutch 206 restricts the rotation of the first drive shaft 123, which is caused by the pivoting movement of the arms 127 made by the second drive shaft 124. The spring clutch 206 also prevents the vertical movement around the proximal end part serving as a fulcrum caused by the first drive shaft 123 when the arms 127 are pivoted by the second drive shaft 124.

That is, it is possible to prevent the pounding movement from being made during the kneading movement and, therefore, the kneading movement can be certainly made by the main massage rollers 137.

On the other hand, when the eccentric rotation of the eccentric cum portion 157 of the eccentric cum body 155 moves downwardly from the top dead center while the second drive shaft 124 is rotated to allow the main massage rollers 137 to make the kneading movement, the second drive shaft 124 may be radically rotated together with the eccentric cum body 155 due to the user's load applied to the main massage rollers 137. That is, the parts of the arms 127 where the main massage rollers 137 are provided may radically fall with the proximal end part serving as a fulcrum.

However, the friction member 207 is provided on the side surface of the second helical gear 198 of the gear train, which transmits the rotation of the reversible motor 182 to the second drive shaft 124. Thus, if the eccentric cum body 155 is to radically rotate together with the second drive shaft 124, the second helical gear 198 slightly moves along the third support shaft 199, and the friction member 207 provided on the side surface of the second helical gear 198 abuts on the outer wall surface of the recess portion 196 to generate the friction force.

As a result, the friction force reduces the speed of rotation of the second drive shaft 124 and the second drive shaft 124 is thereby restricted from rotating radically. That is, it is possible to prevent the main massage rollers 137 from falling radically during the kneading movement and, therefore, preferable massage can be provided.

On the other hand, the arm cover 135 is bonded to the arm housing 132 of the arm 127 and the slider 143 is provided at the holding portion 142 formed between the bonding surfaces thereof.

For this reason, the sliders 143 for allowing the main massage rollers 137 to make the kneading movement can be provided in the arms 127 so as to certainly slide with a simple structure.

The main massage rollers 137 are provided to be freely rotatable on the support shafts 136 formed integrally with the arm housings 132 and are held by fitting the attachment screws 141 in the arm covers 135 through the support shafts 136.

For this reason, the support shafts 136 are constituted integrally with the arm housings 132. Therefore, the structure can be simplified and the assembling operation can be facilitated as compared to a case where they are provided separately from one another, and the main massage rollers 137 can be certainly providing without being loose.

The power box 122, which contains the reversible motor 182, is composed of the metal main body portion 122*a* formed of aluminum die-casting and the lid portion 122*b* formed of synthetic resin. For this reason, when the reversible motor 182 is operated and heat is thereby generated, the heat is radiated to the outside through the main body portion 182. Therefore, it is possible to prevent the heat from being so accumulated inside the power box 122 and the temperature of the reversible motor 182 from rising excessively.

On the other hand, the lid portion 122*b* of the power box 122 is formed of synthetic resin. Thus, the overall power box 122 can be made more right-weight as compared with a case where the overall power box 122 is formed of metal. Further, the lid portion 122*b* is positioned on the outer side in the lateral direction of the holding body 21. For this reason, even if the holding body 21 is in sliding contact with the exterior cover 20 and the like at the time of reciprocates along the guide rails 4, it is possible to prevent the exterior cover 20 and the like from being damaged at an early time.

In the above-described embodiment, the mattress type massage apparatus has been explained. The massage apparatus of the present invention may be designed to be in a chair type. In addition, the center rollers 171 and the side rollers 172 may be formed by foam molding using urethane resin, similarly to the main massage rollers 137 and the auxiliary massage rollers 173.

Figure 33:
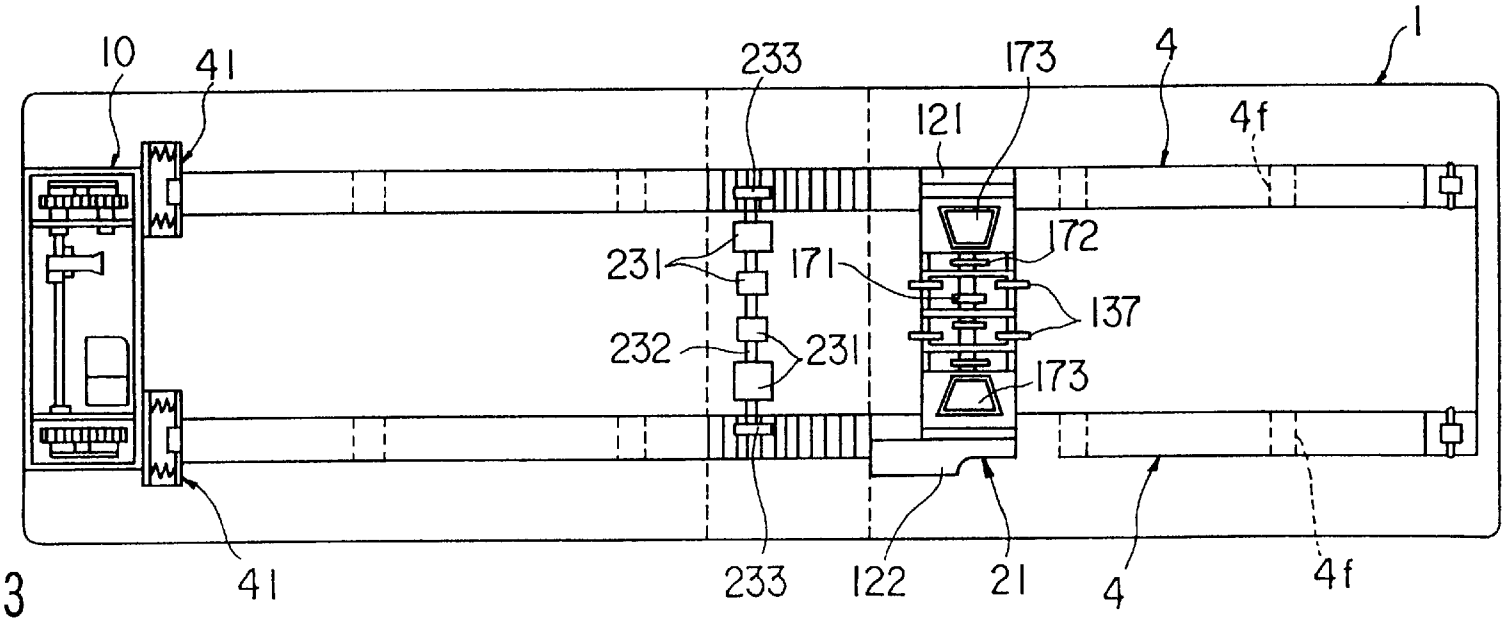
FIG. 33 is a plan view showing a massage apparatus according to a second embodiment of the present invention.

FIG. 33 is a plan view showing the massage apparatus according to a second embodiment of the present invention. In this massage apparatus, an attachment shaft 232 at which a plurality of massage rollers 231 are provided to be freely rotatable at a determined distance from the holding body 21 is provided on a pair of guide rails 4 provided on the base 1, as well as the holding body 21. Support members 233 are provided at both ends of the attachment shaft 232. The support members 233 are coupled to the belts 15 that are driven to run along the guide rails 4.

The projecting part of the power box 122 provided in the holding body 21, i.e. the part in which the reversible motor 182 is provided, faces in a direction opposite to that of the above embodiment, i.e. a direction of the drive device 10. In this case, the first drive shaft 123 is provided on the side portion at an opposite side to the drive device 10 of the holding body 21, though not shown in detail.

In this structure, the massage rollers 231 run along the guide rails 4 together with the holding body 21. Therefore, the massage rollers 231 can also massage the user's body. That is, the massage apparatus having a high massage effect can be provided.

The same portions of the second embodiment as those of the first embodiment are denoted by the same reference numerals and their explanation has been omitted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A massage apparatus comprising:

a holding body which reciprocates along a predetermined direction;

a first drive mechanism configured to reciprocate the holding body;

a first drive shaft having a pair of eccentric shaft portions at a middle portion thereof, and being provided in the holding body while having an axis substantially perpendicular to a reciprocating direction of the holding body;

a second drive shaft provided in the holding body and having an axis parallel to the first drive shaft;

a pair of eccentric cum bodies each having an eccentric cum portion which is eccentric to a middle portion of the second drive shaft and which has an axis inclined to the axis of the second drive shaft;

a pair of arms each having a proximal end portion attached to the eccentric shaft portion of the first drive shaft by a bearing so as to freely oscillate;

a pair of main massage rollers respectively provided at two locations on top sides of the respective arms proximate the end portions thereof, so as to freely rotate;

a slider held to freely slide along a predetermined direction between the pair of main massage rollers of the arms, and fitted in the eccentric cum portions so as to be freely rotatable, for sliding relatively to the arms interlocking the eccentric rotation of the eccentric shaft portions of the first drive shaft; and a second drive mechanism provided in the holding body, for selectively rotating any one of the first and second drive shafts, for assigning pounding movement to the main massage rollers in accordance with the eccentric rotation of the eccentric shaft portions by driving the first drive shaft, and for assigning kneading movement to the main massage rollers in accordance with the eccentric rotation of the eccentric cum bodies by driving the second drive shaft, wherein the second drive mechanism comprises:

a rotating shaft;

a reversible motor selectively rotating the rotating shaft in any of a normal direction and a reverse direction;

a first power transmission mechanism for making the first drive shaft interlock one rotary direction of the rotating shaft; and a second power transmission mechanism for making the second drive shaft interlock the other rotary direction of the rotating shaft;

wherein the first power transmission mechanism comprises:

a first worm gear provided on the rotating shaft to interlock the one rotary direction of the rotating shaft via a first one-way clutch; and a first worm wheel provided at one end portion of the first drive shaft and engaged with the first worm gear; and the second power transmission mechanism comprises:

a second worm gear provided on the rotating shaft to interlock the other rotary direction of the rotating shaft via a second one-way clutch; and a gear train having a second worm wheel engaged with the second worm gear, for transmitting rotation of the second worm wheel to the second drive shaft;

wherein the gear train comprises:

a first helical gear coaxially attached with the second worm wheel;

a second helical gear engaged with the first helical gear; and an intermediate gear integrally formed with the second helical gear engaged with a terminal gear provided on the second drive shaft;

wherein a speed reducing member for reducing a speed of rotation of the gear train when the eccentric rotation of the eccentric cum body is to fall from a top dead center due to the rotation of the second drive shaft is provided at the gear train.

2. A massage apparatus according to claim 1, wherein the first and second helical gears engaged with one another are provided at the gear train;

the speed reducing member serves as a friction member provided on a side surface of one of the helical gears; and when the eccentric rotation of the eccentric cum body is to fall from a top dead center, the friction member is pushed on a fixing member positioned to face the friction member by an axial driving force applied from the eccentric cum body to the one helical gear via the second drive shaft.

3. A massage apparatus according to claim 1, wherein a third one-way clutch for restricting the first drive shaft from rotating in the one rotary direction when the second drive shaft is rotated in the other rotary direction, is provided at the other end portion of the first drive shaft.

4. A massage apparatus according to claim 1, wherein an auxiliary massage roller is provided on a laterally outer side of the holding body than the main massage roller, in the holding body.

5. A massage apparatus according to claim 1, wherein a center massage roller is provided on a laterally inner side of the holding body than the main massage roller, in the holding body.

6. A massage apparatus according to claim 1, wherein the main massage roller is formed by subjecting urethane resin to foam molding.

* * * * *